US011110508B2

(12) United States Patent
Stolp

(10) Patent No.: US 11,110,508 B2
(45) Date of Patent: Sep. 7, 2021

(54) AUTOMATIC PRECISION CLINCHING SYSTEM FOR MANUFACTURING SHEET METAL TUBES

(71) Applicant: David G. Stolp, Poland, OH (US)

(72) Inventor: David G. Stolp, Poland, OH (US)

( * ) Notice: Subject to any disclaimer, the term of this patent is extended or adjusted under 35 U.S.C. 154(b) by 314 days.

(21) Appl. No.: 16/452,763

(22) Filed: Jun. 26, 2019

(65) Prior Publication Data

US 2020/0016646 A1 Jan. 16, 2020

Related U.S. Application Data

(60) Provisional application No. 62/697,458, filed on Jul. 13, 2018.

(51) Int. Cl.

| | |
|---|---|
| ***B21D 39/03*** | (2006.01) |
| ***B21D 39/02*** | (2006.01) |
| ***B21C 37/10*** | (2006.01) |
| ***B21C 51/00*** | (2006.01) |

(52) U.S. Cl.

CPC ..... *B21D 39/031* (2013.01); *B21C 37/10* (2013.01); *B21C 51/00* (2013.01); *B21D 39/02* (2013.01)

(58) Field of Classification Search

CPC ..... B21D 39/02; B21D 39/031; B21D 5/015; B21D 5/10; B21D 5/12; B21D 5/146; B21D 11/203; B21C 37/0815; B21C 37/0822; B21C 37/10; B21C 37/101; B21C 37/108

USPC ..... 72/48, 51, 367.1, 368, 389.1

See application file for complete search history.

(56) References Cited

U.S. PATENT DOCUMENTS

| | | | | |
|---|---|---|---|---|
| 737,989 | A * | 9/1903 | Wolfe | B21C 37/0815 72/51 |
| 2,878,766 | A * | 3/1959 | Ely | B21C 37/108 72/20.5 |
| 3,112,087 | A * | 11/1963 | Fornataro | B21C 47/066 72/155 |
| 3,732,614 | A * | 5/1973 | Boutell | H02K 15/14 228/150 |

(Continued)

OTHER PUBLICATIONS

BTM Company LLC, Die Set Examples, HVAC Industry, Common Part Configurations, May 11, 2018-May 16, 2018, http://www.btmcorp.com.

(Continued)

*Primary Examiner* — Edward T Tolan

*Assistant Examiner* — Jared O Brown

(74) *Attorney, Agent, or Firm* — Roth Blair Roberts Strasfeld & Lodge

(57) ABSTRACT

A system for automatically forming sheet metal tubes from blanks cut to size. The system having a mechanism for positioning a blank for processing. A lifting arrangement having a wrap strap and pressure pad to raise the blank to a forming station having a mandrel is positioned so that the wrap strap extends on either side of said mandrel and underneath the blank before a side wiper on each side of said mandrel forces the overlap of opposite edges of the blank along a length of the mandrel. The mandrel includes a clinching die bar along its length. A sealing mechanism with a vertically movable row of clinching prongs is lowered to (Continued)

attach the overlapping edges of the blank by clinching at multiple positions to form a tube around the mandrel before being removed by a gag bar and a stripper plate.

14 Claims, 34 Drawing Sheets

(56) References Cited

U.S. PATENT DOCUMENTS

| | | | | |
|---|---|---|---|---|
| 3,802,239 | A * | 4/1974 | Karmann | B21C 37/185 72/51 |
| 4,169,307 | A | 10/1979 | Weinzimer et al. | |
| 4,513,596 | A * | 4/1985 | Usher | B21C 37/108 72/51 |
| 4,546,528 | A | 10/1985 | Langas | |
| 5,848,464 | A | 12/1998 | Baker et al. | |
| 7,669,448 | B1 * | 3/2010 | Gharib | B21C 37/108 72/51 |
| 9,156,510 | B2 | 10/2015 | Petit et al. | |
| 9,421,599 | B2 | 8/2016 | Sawdon et al. | |
| 9,889,530 | B2 | 2/2018 | Petit et al. | |
| 9,908,171 | B2 | 3/2018 | Faitel | |
| 9,931,720 | B2 | 4/2018 | Sawdon et al. | |
| 9,933,092 | B2 * | 4/2018 | Sindelar | B21D 5/015 |
| 9,957,992 | B2 | 5/2018 | Noe et al. | |

OTHER PUBLICATIONS

BTM Compant LLC, Tog-L-Loc Sheet Metal Clinching System, May 16, 2018, Marysville, MI, http://www.btmcorp.com/tog-l-loc.html?gclid=EAIaIQobChMI4ajrhsWK2wIVA77ACh36mA_zEAAYASAAEgl6DvD_BwE#part-compatibility-anchor.

BTM Company LLC, Joining Metals with Stamping Dies, Marysville, MI, http://www.btmcomp.com.

BTM Company LLC, A BTM Special Machine Clinching Three Tog-L-Loc Joints at once, May 11, 2018, https://www.youtube.com/watch?v=GDXTsCrVhJU.

BTM Company LLC, Tog-L-Loc Clinch Tooling, Marysville, MI, http://www.btmcomp.com.

Multicyl, Power to Punch with Multicyl, May 11, 2018, Ontario, Canada, http://www.multicyl.com/applications/multiloc.

Bollhoff Attexor SA, RIVClinch Automatic Clinching Station for Joining Pocket Air Filters. May 11, 2018, Préverenges, Switzerland, https://www.bollhoff-attexor.com/products/modular-systems/joining-pocket-air-filters.html.

Nantong Zhenhuan Trade Co. Ltd., Tube Hose Machine, May 11, 2018, Rugao City, Jiangsu Province, China, http://www.zhenhuan-machine.com/html_products/Radiator-Tank-Clinching-Machine-191.html.

* cited by examiner

AUTOMATIC PRECISION CLINCHING SYSTEM FOR MANUFACTURING SHEET METAL TUBES

PRIORITY INFORMATION

The present application claims priority from U.S. Provisional Patent Application No. 62/697,458, filed on Jul. 13, 2018.

FIELD OF THE INVENTION

The present invention relates generally to systems and methods for manufacturing sheet metal tubes, including sheet metal tubing used in air moving and control systems. In particular, the present invention is directed to a machine, system and method for precision manufacturing of clinched sheet metal tubes.

BACKGROUND OF THE INVENTION

Sheet metal tubing is manufactured in a wide variety of diameters, lengths, and thicknesses (within the general parameters used for defining sheet metal). Sheet metal tubes are especially prevalent in systems for moving and controlling the flow of air. Such systems can include heating, air-conditioning, and exhaust systems such as those found on dryers, as well as industrial gas handling systems. The use of sheet metal tubing is prevalent because this material can be easily worked into many configurations, and it is relatively inexpensive. Accordingly, the beneficial increased use of sheet metal tubing is facilitated by further decreasing the costs and complexity of manufacturing sheet metal tubing.

Sheet metal tubes are generally made using multiple rollers (such as a pyramid system) to form large cut sheets into tubes having opposite longitudinal edges that must later be connected together to form the finished tube. The most time-consuming aspect of this process is the connecting of the opposite longitudinal edges of each formed sheet into a finished tube.

There are a wide variety of different techniques for connecting such longitudinal edges together. Currently, the most popular technique is laser welding. However, this is expensive (in both capital expenditure and operation) and requires substantial factory floor space.

Older, more economical systems include manual clinching. This is done by a craftsman or metalworker holding overlapping longitudinal edges of the tube together and manually making individual clinch connections along the length of the tube. Recently, clinching machines by such manufacturers as BTM Company LLC (Bloomfield Hills, Mich.), automatically perform multiple clinching operations along the length of flat overlapping metal sheets, or even perform simultaneous clinching along the entire length of a sheet metal tube.

Another traditional technique for making a connection along the edges of a sheet metal tube is by use of rivets. Consequently, this is typically done using individual rivets, manually applied by a metalworker. Moreover, the metalworker performs the riveting operation at various locations along the length of a sheet metal tube. Even with automatic indication of where the rivets should be placed, there is a certain amount of inaccuracy in the operation due to operator error.

A further traditional method is directed to folding the edges of a sheet metal tube to create a locking configuration along the length of the two longitudinal edges, and then connecting these together. While such an operation is generally performed easily and quickly, the connection between the longitudinal edges of the tube can be compromised by substantial flexing or deformation of the tube. Further, on account of the many thicknesses of sheet metal required for the various tubular components used in the industry, the folded connection-method has difficulties for particular tubes that are used in certain applications.

One such application is the standard elbow manufacturing machine, which requires the absence of thickened tube structures at various locations on the elbow that require the sliding of two adjacent tube sections. Consequently, certain traditional locking structures, while simple to construct, are often avoided for use in standard elbow machines, as well as other applications requiring precise tube configurations.

The same problem can occur with riveted tubes due to the overall thickness of the rivet's structure. Consequently, the manufacture of riveted sheet metal tubes using elbow manufacturing machines is problematical. Even clinched structures can be problematic in some applications, especially if individual clinch connections are located at awkward positions. This happens frequently with manual clinching.

Conventional tubes made by manual clinching operations are time-consuming to produce. This problem is addressed when the clinching is done on a special machine, which carries out simultaneous clinching along the length of the tube.

Even with automatic, simultaneous clinching, the overlap of the opposite edges can introduce inaccuracies in the diameters of the final tubes produced. Further, the general process of rolling sheet metal to form the tubes, and then moving the incomplete tubes to another machine or manufacturing station to perform the connection operation, is slow and ultimately expensive (while often producing flawed or imprecise finished tubes).

While a much higher degree of accuracy is achieved using laser welding of the edges of the tube, laser welding requires very high capital investments in welding equipment. This cost is sufficiently high that many manufacturers rely upon manual riveting, manual clinching, and folded connection structures of sheet metal tube edges (which are less expensive), despite the aforementioned drawbacks of these techniques.

Further, even with accurate laser welding, conventional systems allow awkward variations in the diameters of the completed tubes due to inaccuracies in the cutting of the metal blanks, and the handling and deformation of those blanks. The variations in the resulting tube diameters often make them difficult to work with in systems requiring accuracy, such as conventional elbow machines.

Accordingly, there is a need for a system to quickly and efficiently manufacture accurate sheet metal tubes, without the exorbitant capital investment required by laser welding machines.

The desired system would produce sheet metal tubes that are suitable for use in elbow machines and are sufficiently uniform in diameter to be used in precision systems, as well as to be easily used in any system requiring sheet metal tubing. The system should be easy to modify for different diameters of sheet metal tubes, relatively inexpensive to operate, and capable of limiting the effort necessary for the overall sheet metal tube manufacturing process. As with any manufacturing system, operating costs and manufacturing time need to be reduced to a minimum.

SUMMARY OF THE INVENTION

Accordingly, it is a major object of the present invention to provide a system for manufacturing sheet metal tubes that eliminates select manual manufacturing steps and speeds the overall process.

It is another object of the present invention to provide a manufacturing system that facilitates easy and efficient variations in tube sizes and diameters, as well as accommodating other structural features of the tubes, such as corrugation.

It is a further object of the present invention to provide a system to facilitate precise automatic clinching along overlapping tube edges.

It is an additional object of the present invention to provide a manufacturing system that integrates tube formation with attachment of the longitudinal tube edges to form a complete structure.

It is still another object of the present invention to provide a manufacturing system that carries out near simultaneous formation of the tube and connection of the longitudinal tube edges.

It is yet a further object of the present invention to provide an automatic manufacturing system that is capable of automatically providing desired clinching patterns, so as to facilitate use of the tubes in elbow machines.

It is again an additional object of the present invention to provide a manufacturing device for sheet metal tubes that produces tubes without notches or other deformations.

It is again another object of the present invention to provide a sheet metal tube manufacturing system that requires less labor and provides greater automation than conventional systems, by avoiding manual clinching or riveting operations.

It is yet a further object of the present invention to provide a sheet metal tube manufacturing system that avoids conventional three-roll tube forming machinery.

Is still an additional object of the present invention to provide a sheet metal tube manufacturing system in which precise diameters of individual tubes are made uniformly to facilitate precise tubes for various precision applications.

It is again a further object of the present invention to provide a sheet metal tube sealing system that is substantially a third of the cost of conventional laser welding systems.

It is again a further object of an alternative of the present invention to provide a sheet metal tube manufacturing system that facilitates robotic collection of finished tubes, thereby avoiding the need for manual handling of finished tubes.

It is again a further object of an alternative of invention to provide a sheet metal tube manufacturing system that facilitates robotic feeding of cut sheet metal blanks into the system for automatic formation into clinched sheet metal tubes.

It is still a further object of the present invention to provide a sheet metal tube manufacturing system that quickly and efficiently accommodates changes in tube diameter, tube length, and connection patterns.

It is still an additional object of the present invention to provide a sheet metal tube manufacturing system that facilitates easy release of the finished sheet metal tube from the manufacturing system.

It is yet another object of the present invention to provide a sheet metal tube manufacturing system that requires less capital investment and operating cost than is required for conventional sheet metal tube manufacturing systems.

It is again a further object of the present invention to provide a sheet metal tube manufacturing system that easily and accurately accommodates changes in the connection configurations for holding the tube together.

These and other goals and objects of the present invention are achieved by a system for automatically forming sheet metal tubes from sheet metal blanks that have been previously cut to size. The system includes a preliminary processing system for moving each sheet metal blank into a predetermined position and a precise horizontal orientation for further processing. Also included is a lifting arrangement at the predetermined position in which the sheet metal blank is held. This arrangement includes wrap straps and at least one pusher structure with a pressure pad to vertically hold the sheet metal blank and the strap wrap to a mandrel above the strap wrap and the blank, so as to maintain the precise horizontal orientation of the sheet metal blank. The system also includes a forming station having the mandrel positioned so at least one strap wrap extends on either side of the mandrel and underneath the sheet metal blank, wherein the pressure pad and strap wrap maintain pressure on the sheet metal blank against the mandrel. The forming station further includes at least one side wiper on each side of the mandrel. The side wipers are configured to force overlapping of two opposite edges of the sheet metal blank along an upper apex of the mandrel. The mandrel further includes a clinching die bar extending along the upper apex of the mandrel. A sealing mechanism is located above the upper apex of the mandrel and includes a vertically movable row of clinching prongs corresponding to the clinching die bar. The sealing mechanism is configured to automatically lower and attach the two opposite edges of the sheet metal blank by clinching the opposite overlapping edges of the sheet metal blank at multiple positions to form a sheet metal tube around the mandrel. A separating mechanism includes a stripper plate and is configured to remove the sheet metal tube from the mandrel. The separating mechanism includes a gag bar located within the mandrel and underneath the clinching die bar, so that movement of the gag bar allows the clinching die bar to move downward. Also included is a stripper plate preferably curved at least partially around the mandrel.

BRIEF DESCRIPTION OF THE DRAWINGS

The following descriptions depict only example embodiments and are not to be considered limiting of its scope. Any reference herein to "the invention" is not intended to restrict or limit the invention to exact features or steps of any one or more of the exemplary embodiments disclosed in the present specifications. References to "one embodiment," "an embodiment," "various embodiments," and the like, may indicate that embodiment(s) so described may include a particular feature, structure, or characteristic, but not every embodiment necessarily includes the particular feature, structure, or characteristic.

Accordingly, the particular arrangements disclosed are meant to be illustrative only and not limiting as to the scope of the invention, which is to be given the full breadth of the claims and any and all equivalents thereof. Although specific terms are employed herein, they are used in a generic and descriptive sense only and not for purpose of limitation. As used herein, the article "a" is intended to include one or more items. When used herein to join a list of items, the term "or" denotes a least one of the items but does not exclude a plurality of items of the list.

DETAILED DESCRIPTION OF THE PREFERRED EMBODIMENTS

Figure 1:
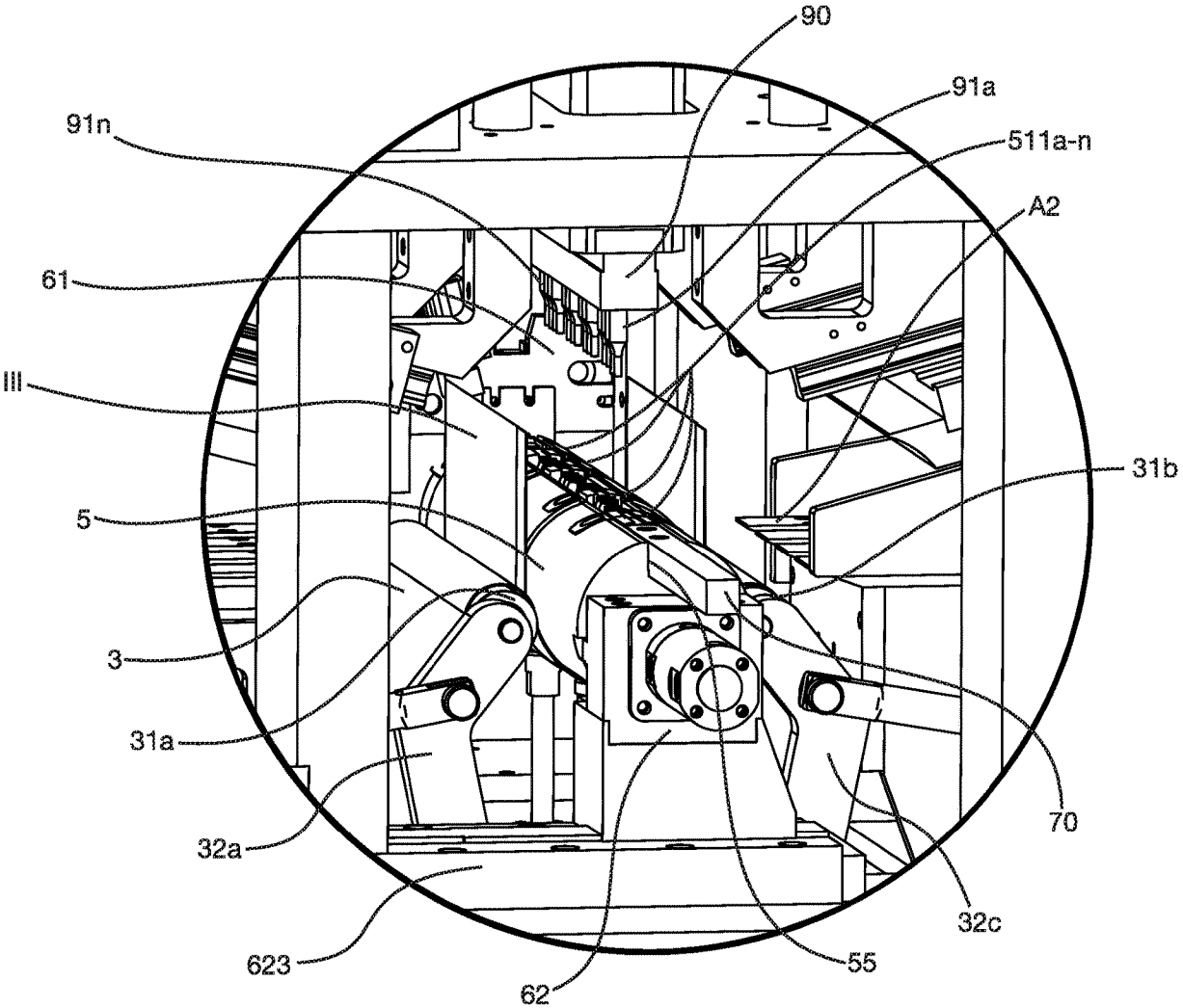
FIG. 1 is a partial side perspective detailed view depicting a wrap strap holding a sheet metal blank against the lower portion of the outside of a mandrel.
Figure 2:
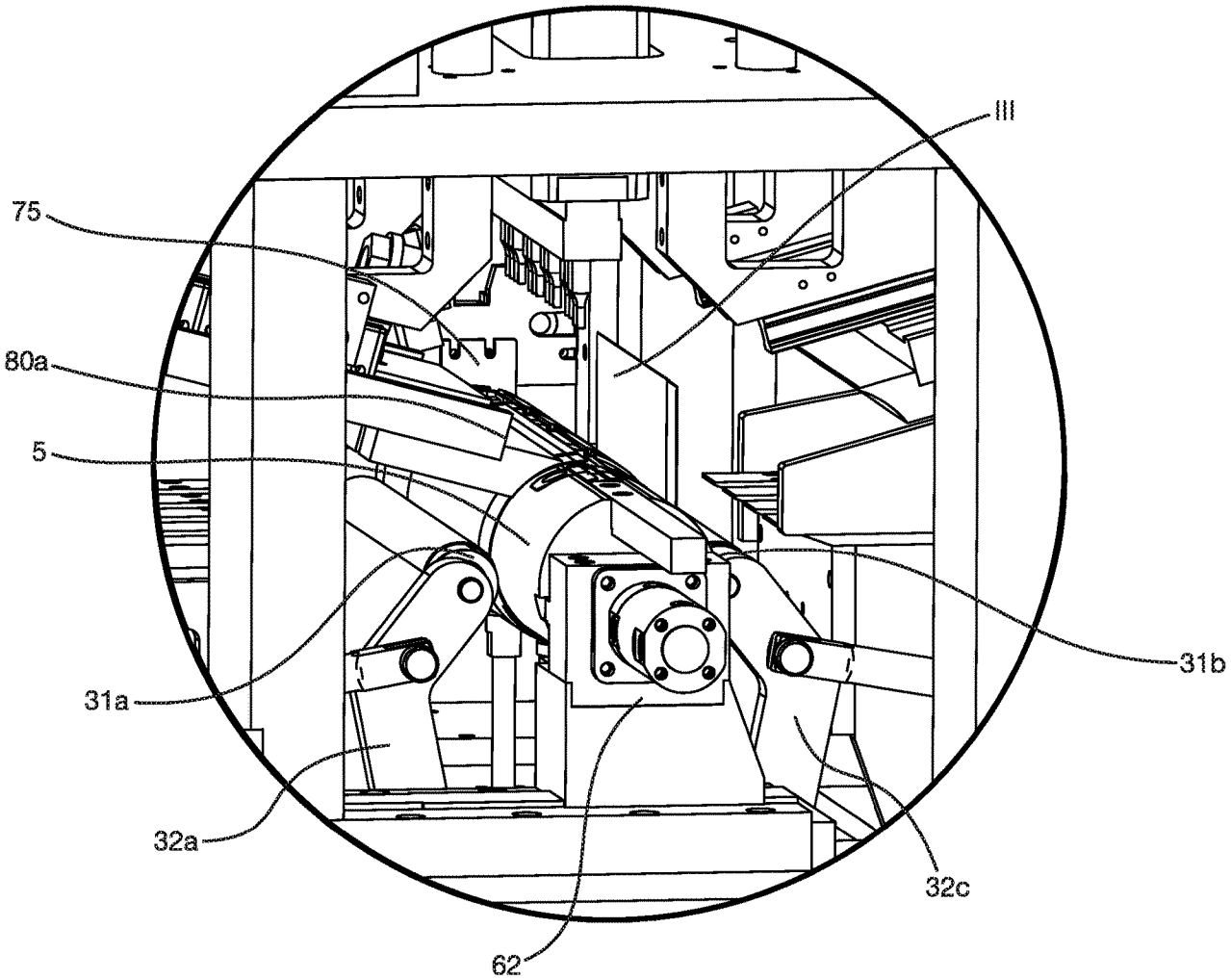
FIG. 2 is a partial side perspective detailed view depicting the operation of a first side wiper, forming the sheet metal blank against the upper portion of the mandrel.

The present invention is directed to an integrated system for forming sheet metal tubes from sheet metal blanks (III) and securing together the opposite edges of the formed tubes to provide a final tube product. The system maintains a substantially uniform diameter for all tubes (IV) formed, despite any variations and/or imperfections in blank sizes, sheet metal thickness, and the like.

This is an important benefit of the present invention since there are numerous applications in which uniformity of tube diameter is crucial. One such example is elbow manufacturing machines. Further, the tubes made by the inventive system have a preferably thin, clinched connection between tube edges in a uniform, precise manner so as to facilitate use of the final tubes in various applications that require the clinched connections to be placed in tightly fitted, difficult locations.

Conventionally, the desired precision in sheet metal tube manufacture is not achieved without substantial investment in precision machinery, and substantial operating expenses, such as those incurred with laser welding machines. While laser welding may be precise, it is expensive both in capital investment and in operating costs. Further, additional processing and movement of both raw and finished products are necessary since laser welding machines create undesirable byproducts, and must be segregated to some extent within the manufacturing plant. Consequently, a great deal of time and effort must be expended transporting material to and from the laser welding station.

The present invention overcomes these difficulties by integrating the operations for tube formation and the connection of the longitudinal tube ends in one machine (I), and in a near-simultaneous and automatic set of operations. Further, the integrated operation of the present inventive system may use robotics, such as a lifter (A5) at the beginning of the feeding unit (II) for feeding precut metal blanks (III) to the subject forming system (I) and for removing the finished tubes (IV) to be advanced in further processing (such as downstream elbow forming machine processing). The present tube forming system (I) is sufficiently compact so that it can be fed from an external robotic blank cutting machine along a conveyor (such as the conveyor A2 shown in the drawings). Further, the finished tubes (IV) can be removed from the product extraction support bar (70) attached to the mandrel (5) using an external robot (not shown) that would then transport the finished tube (IV) to a nearby external elbow forming machine (as just one example of added downstream processing for the finished tube).

The present invention uses simultaneous clinching along the entire length of the sheet metal tube (IV) in order to provide rapid sealing/secured fastening of the opposite and overlapping edges of the blank (III) (i.e., to form the tube). This is much less expensive than laser welding and much faster than conventional manual clinching or riveting operations. Further, conventional manual operations for connecting the opposite edges of sheet metal blanks to form tubes become increasingly expensive with the use of both skilled and unskilled labor for the connection processes. This is avoided by the present invention.

A key benefit of the present invention is the precision with which each tube (IV) is formed and then clinched in near simultaneous operations. This results in uniform tube diameters, despite any variations in the sizes and thicknesses of the sheet metal blanks (III) fed into the inventive tube forming machine (I).

Figure 9:
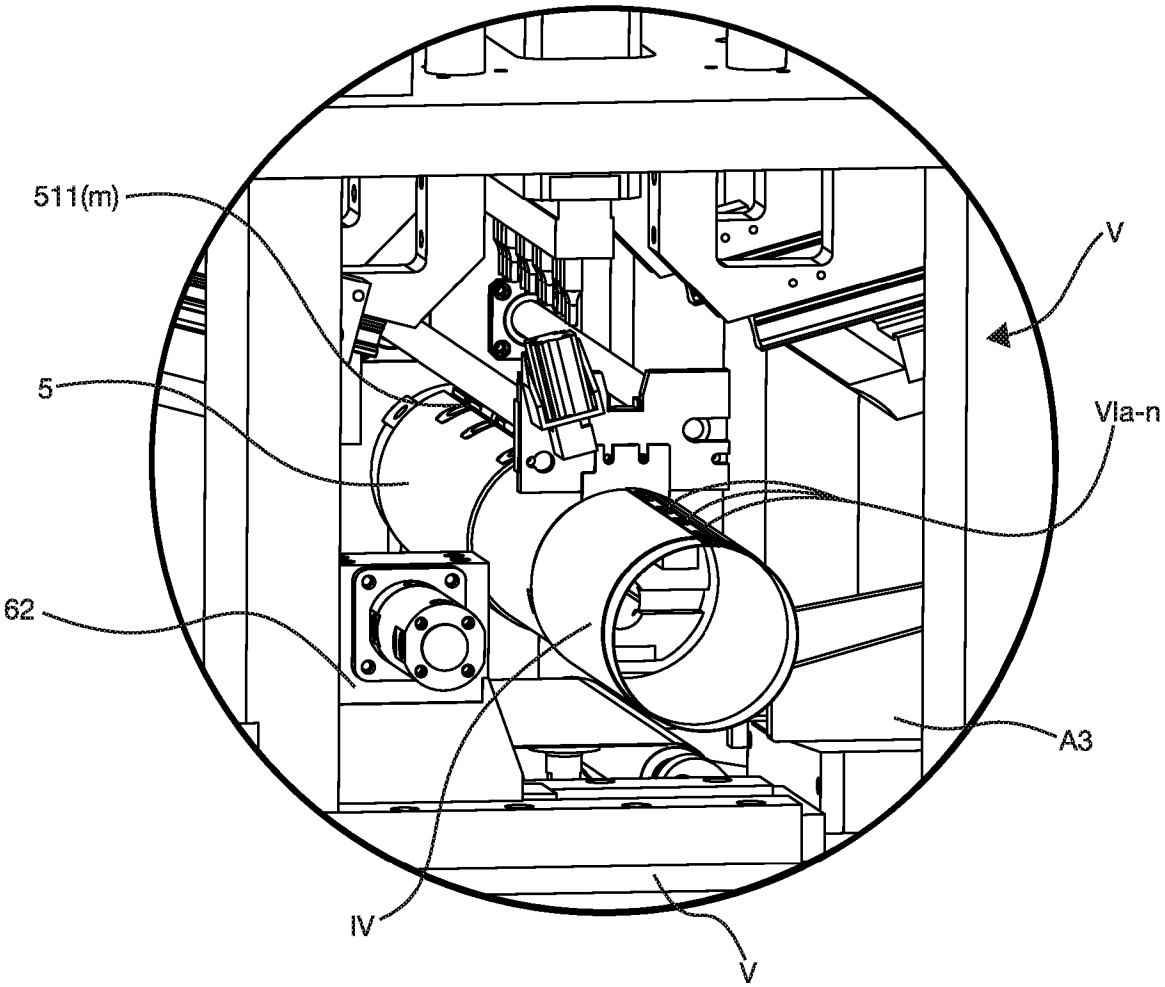
FIG. 9 is a partial side perspective view depicting the finished sheet metal tube being slid off the open-end of the mandrel.

Further, the use of the present invention avoids the use of a conventional pyramid or three-roll tube forming machine operation. Typically, in conventional processes these machines are used to roll a number of tubes, which are then all moved from the rolling machine to another workstation at which the opposite edges of the tubes are connected together. The connection step is then completed by various forms of welding, riveting, or manual clinching (clinching in this case is automatic but, by way of example, is shown in FIG. 9 as VI(a),(b),(c) . . . (n) on the finished tube (IV) being removed from the mandrel (5)). A major problem with the existing arrangement is that tube diameters can vary substantially, as can the location, spacing and patterns of connectors (clinches, welds or rivets).

An important aspect to the operation of the present invention is the precision with which each sheet metal blank (III) is held, formed and sealed together. This is achieved by a combination of different factors operating together to repeatedly and automatically provide the resulting precise tube diameter and connection pattern. This precision is begun by the manner in which each sheet metal blank (III) is moved and then held in place during the manufacturing process.

The preferred feeding unit (II) is a conveyor A2 (seen in FIGS. 11, 13, 18, 20, 30, 32 and 33), which moves each sheet metal blank (III) to a set of stops (2, 22(*a*), 22(*b*)) on a processing table (1). The stops (2, 22(*a*), 22(*b*)) align and hold the sheet metal blank (III) on three sides. Fingers (A4) on the blank conveying system (A2) of the feeding unit (II) force the sheet metal blank against the end stop (2), while short side stops (22(*a*), 22(*b*)) provide holding action from two opposite sides. Optionally, the conveying system (A2) of the feeding unit (II) can have side rails (A3) that help guide the sheet metal blank (III) into the correct position of the three-sided stop arrangement on the processing table (1). The correct positioning of the sheet metal blank is especially important to maintain proper position throughout the tube formation and edge connection processes.

Figure 10:
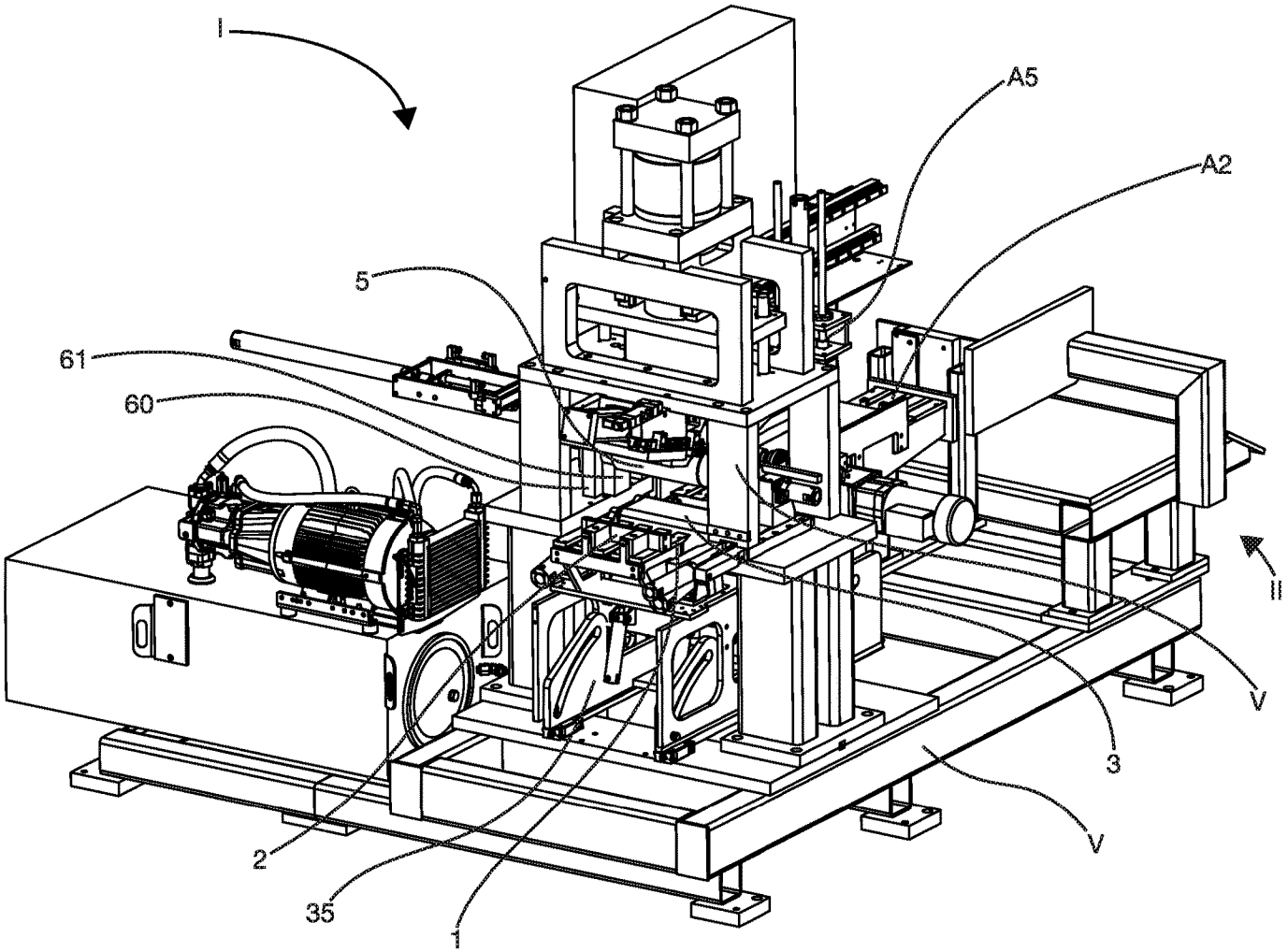
FIG. 10 is a perspective view of the subject sheet metal tube forming system, including a feeding unit to bring cut sheet metal blanks to the forming system.
Figure 11:
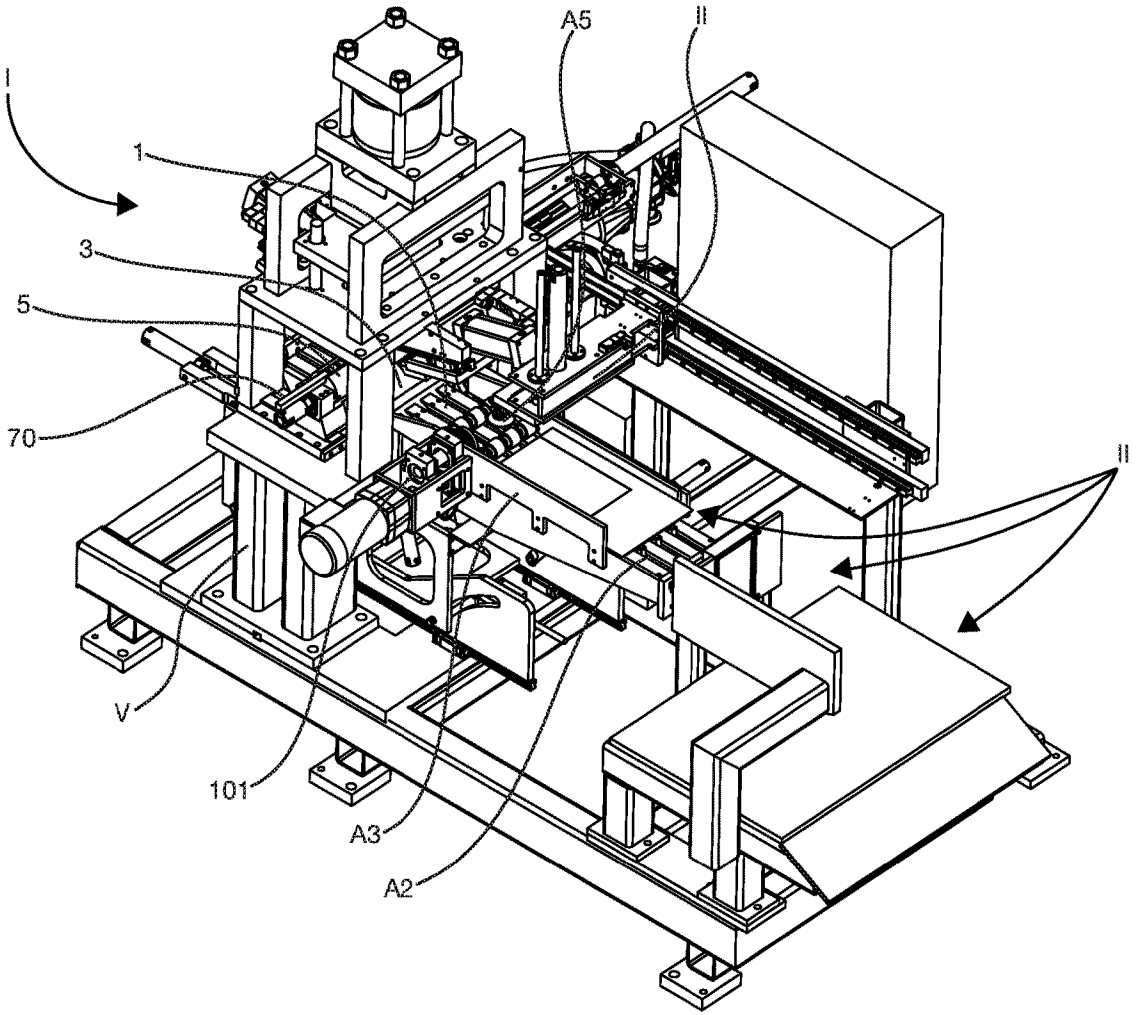
FIG. 11 is a top perspective view of the subject tube forming system and feeding unit of FIG. 10.
Figure 19:
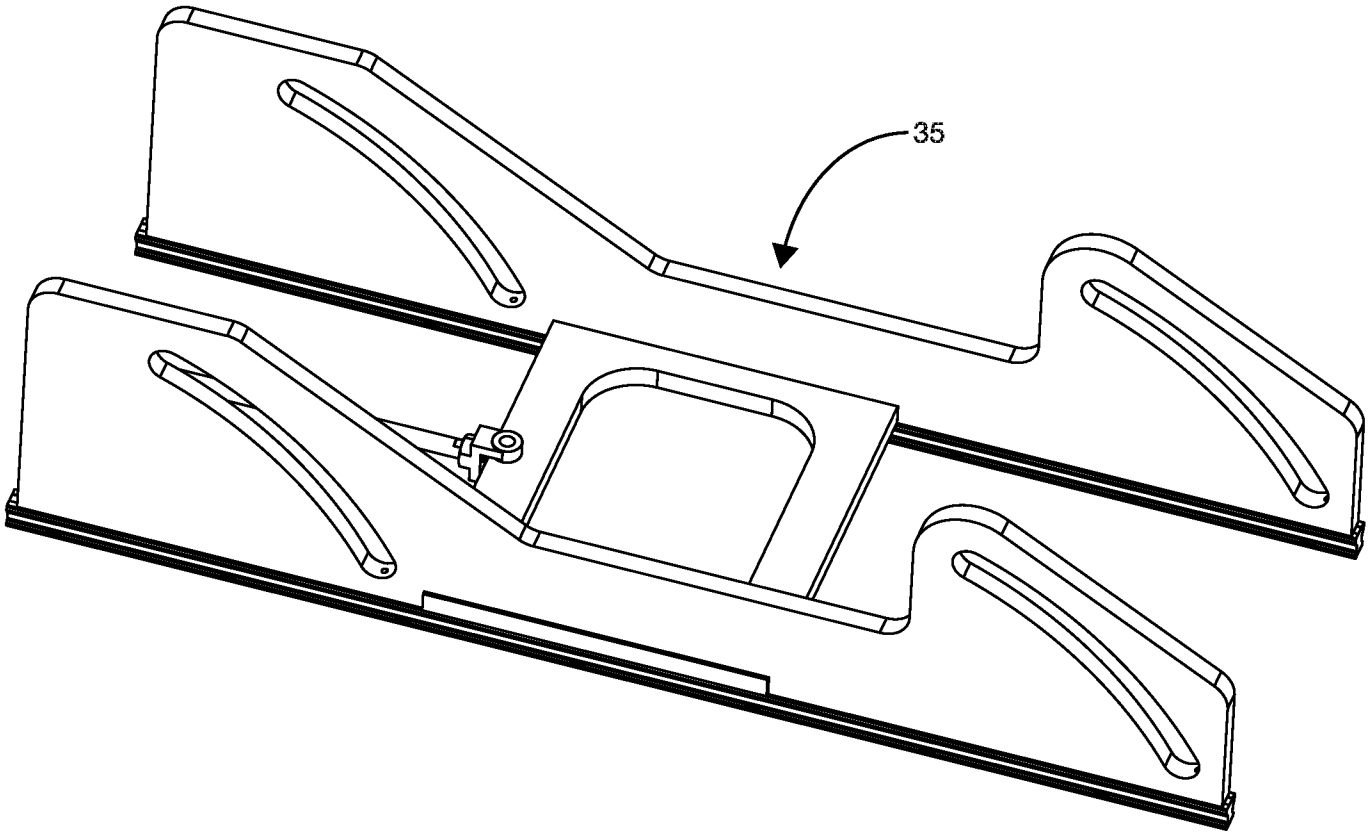
FIG. 19 is a top perspective view of the cam support used for raising the strap wrap and sheet metal blank holding arrangement to the mandrel.
Figure 20:
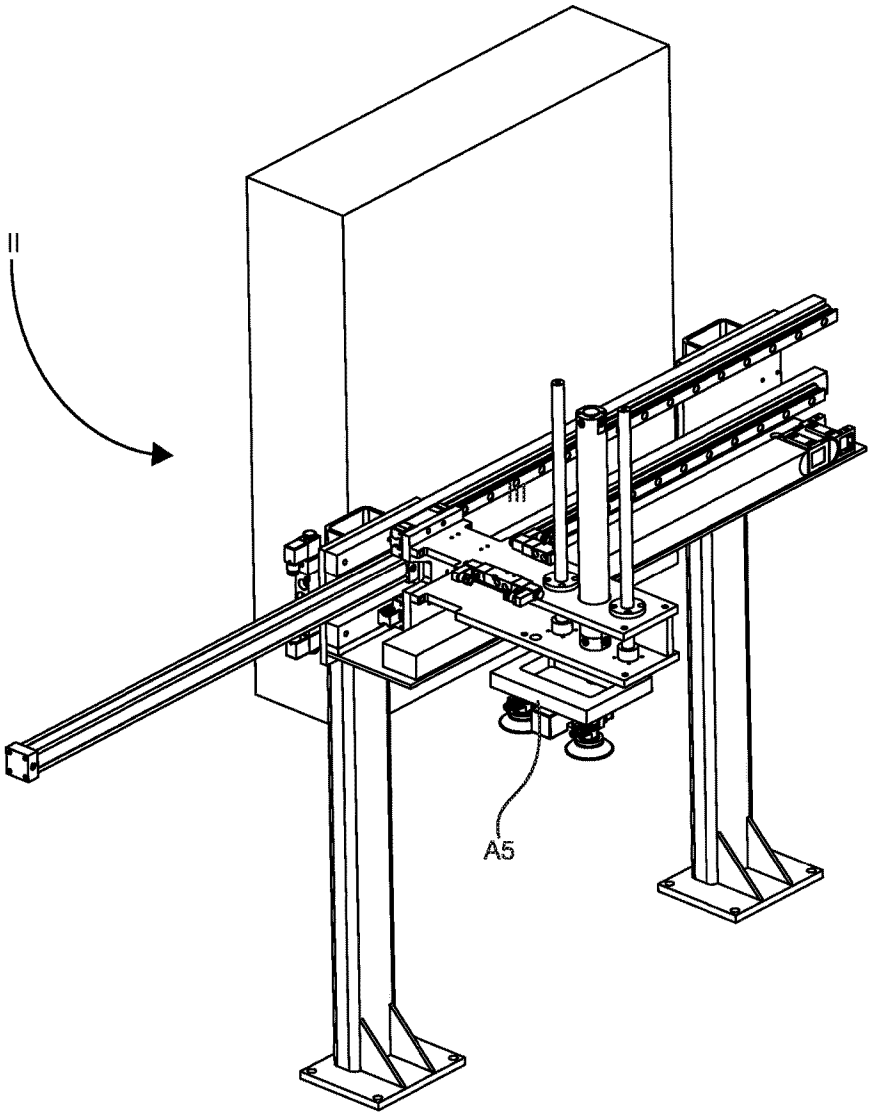
FIG. 20 is a perspective view of the sheet metal blank lift device for moving a blank to the conveying system.
Figure 21:
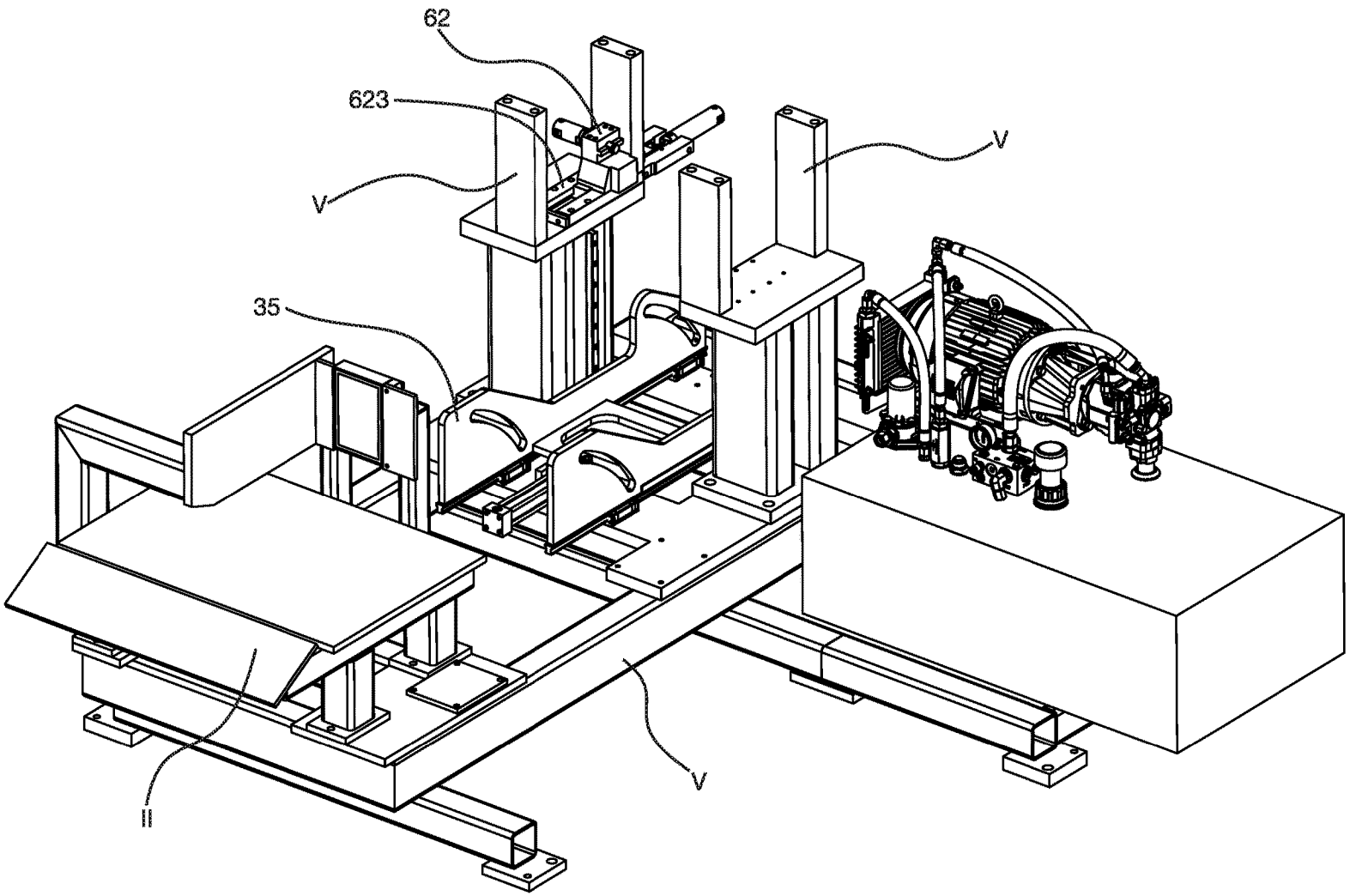
FIG. 21 is a perspective view showing the system for powering various hydraulic cylinders used throughout the system.

The processing table (1) is designed to move upwards to a precisely fixed mandrel (5). The lifting of the processing table (1) can be accomplished in a number of different ways. In one preferred embodiment, a cam lifting structure (35) is used as a guide for lifting the processing table (1), including all of the other equipment associated therewith (as described below). The cam lifting structure (35) is fully depicted in FIG. 19 and is easily identifiable in FIGS. 10 and 13. While the use of the structure is found in one preferred embodiment, other lifting arrangements can be used to bring wrap strap (3) and sheet metal blank (III) to the bottom apex of mandrel (5).

Figure 15:
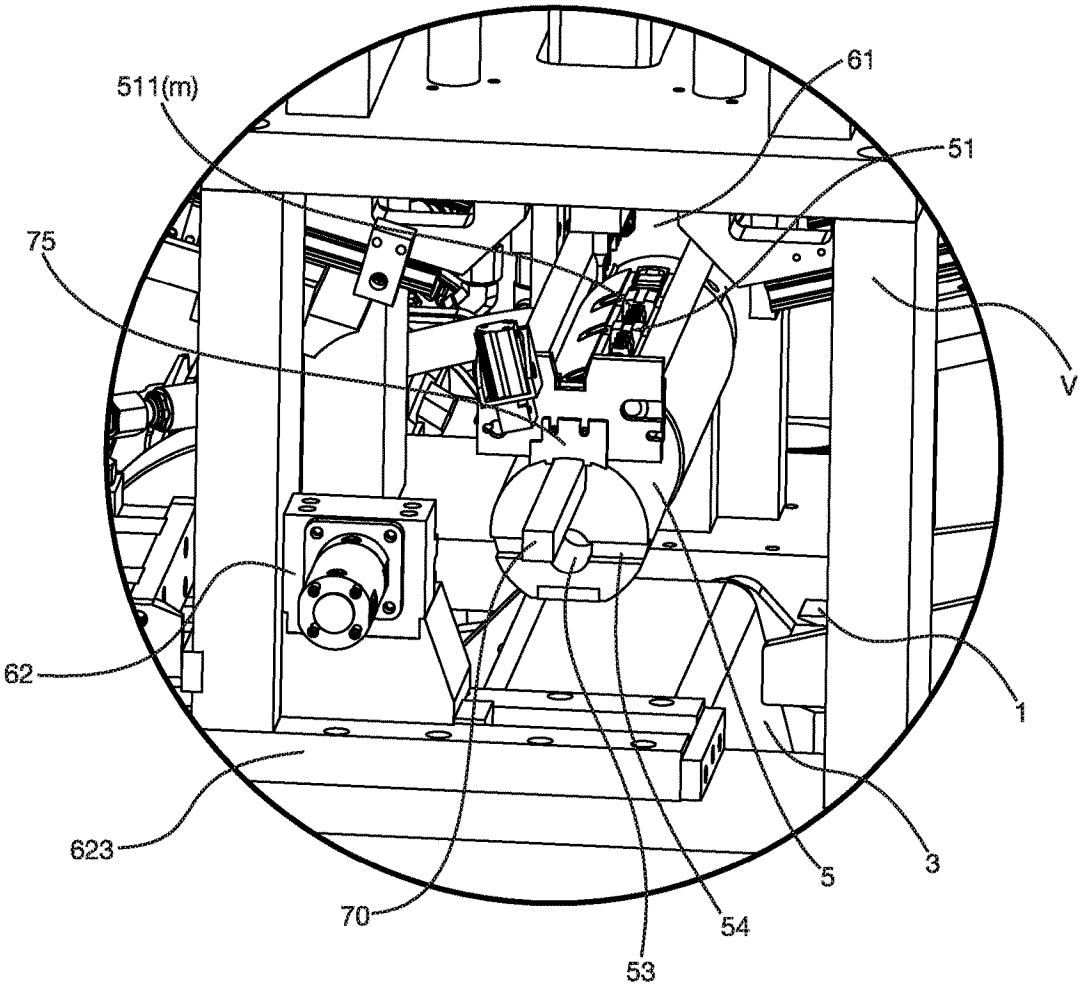
FIG. 15 is a partial detailed perspective view of the mandrel with the open-end mandrel holding arrangement slid to the side, and the stripper plate in the extended position.
Figure 31:
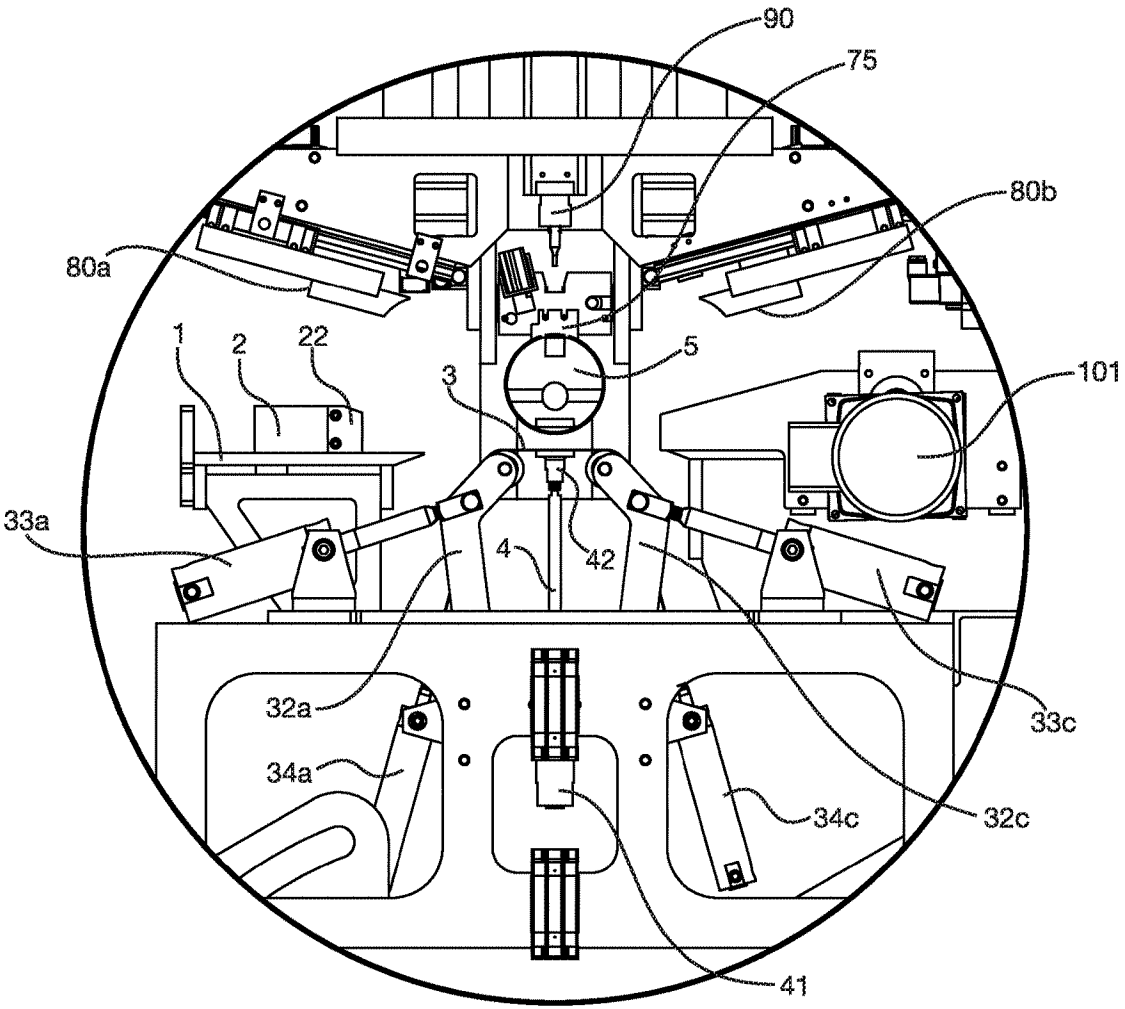
FIG. 31 is a side view of the wrap table in relationship to the mandrel.
Figure 34:
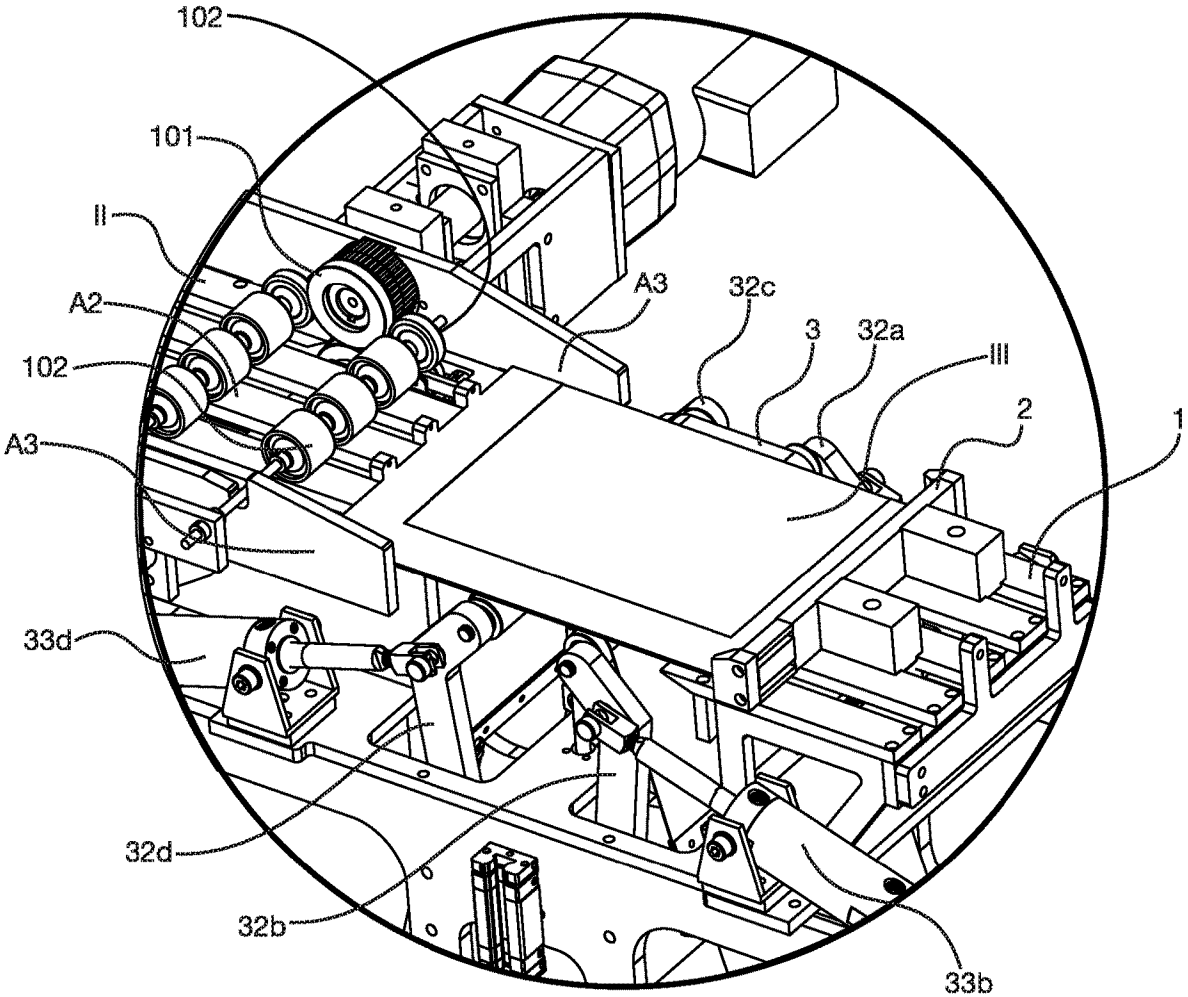
FIG. 34 is a top perspective view of a sheet metal blank conveyed, oriented and arranged over the wrap table in a precise location for the forming steps depicted, for example, in FIGS. 1 through 9.

In the preferred embodiment, the processing table (1) includes wrap strap (3) initially positioned under the sheet metal blank (III) when in the stop position as best seen in FIG. 34 (without the mandrel shown). When the entire processing table (1) then moves up, the sheet metal blank (III) is forced by the wrap strap (3) against the bottom of the mandrel (5), exerting substantial and uniform force by the wrap strap (3) to move the two ends of the sheet metal blank (III) against and around the bottom half of the mandrel (5) (as best illustrated for reference to FIGS. 1, 15 and 16; also seen in FIGS. 31-33). Further, the sheet metal blank (III) is held against the bottom of the mandrel (5) using at least one pressure pad (42) (either pneumatically or hydraulically driven on a pusher bar (4) by cylinder (41) seen in FIGS. 31 and 33) to maintain the sheet metal blank (III) in secured position against the bottom apex of the mandrel (5) (through the wrap strap (3) engagement step).

As the processing table (1) is moved up with the pressure pad (42), the wrap strap (3) forces the blank (III) tight against the bottom apex of the mandrel (5). Moreover, the wrap strap (3) operates rapidly to bring the two sides of the sheet metal blank (III) around the mandrel (5) on both sides, as depicted in FIG. 1. The wrap strap (3) forces the sheet metal blank (III) into a curved position on the mandrel (5) with two opposite ends of the blank in parallel with each other. The speed at which this operation takes place is sufficiently fast that there is no movement or dislocation of the sheet metal blank with respect to its original location in the stops (2, 22) on the processing table 1.

Wrap strap (3) is controlled using two sets of pneumatic (or hydraulic) cylinders on each side of wrap strap (3). More specifically, cylinders (34(*a*)/(*b*) and 34(*c*)/(*d*)) on opposite sides of the mandrel (5) are used as holding cylinders to maintain tension on the wrap strap (3) (see, for example, FIGS. 32 and 33). At the same time, during the operation of the wrap strap (3) lifting step, lifting cylinders (33(*a*)/(*b*) and 33(*c*)/(*d*)) on opposite sides of the mandrel (5) are used to quickly and forcefully raise rollers (31(*a*)/(*b*)), using roller lifting arms 32(*a*)/(*b*)/(*c*)/(*d*), respectively, to form the sheet metal blank (III) around the bottom-half of the mandrel (5). All eight of the aforementioned cylinders act in unison to lift the wrap strap (3) to create the force necessary for the rapid formation of the sheet metal blank (III) around the bottom of the mandrel (5). This rapid operation using the wrap strap (3), along with the simultaneous clinching of the entirety of the overlapping two edges of the tube (discussed immediately below and shown in sequential steps in FIGS. 2-7), is a major benefit of the present invention.

To be clear, the operation of the wrap strap (3) forces the two ends of the sheet metal blank (III) to be parallel to each other on opposite sides of the mandrel (5) (see again, FIG. 1). The next step of the operation is directed to the two wiper plates (80(*a*), 80(*b*)) located above and on opposite sides of the top-half of the mandrel (5). Depending upon the specifications required of the final tube (IV) folding arrangement, one or the other of the two wiper plates (80(*a*), 80(*b*)) will operate first to bring one side of the sheet metal blank (III) over the top of the mandrel (5). Then, the other wiper plate will operate to bring the second side down over the first (see, FIG. 2). The overlap of the two sides of the sheet metal blank (III) occurs on the upper apex of the mandrel (5), both directly above and covering clinching die bar (51).

It is necessary that both edges of blank III extend fully over clinching die bar (51) to ensure a proper connection operation. The deformation of material caused by the subsequent clinching operation, deforms the metal by stretching it. Consequently, unless sufficient material is provided over the clinching area, the clinches could be compromised.

Figure 3:
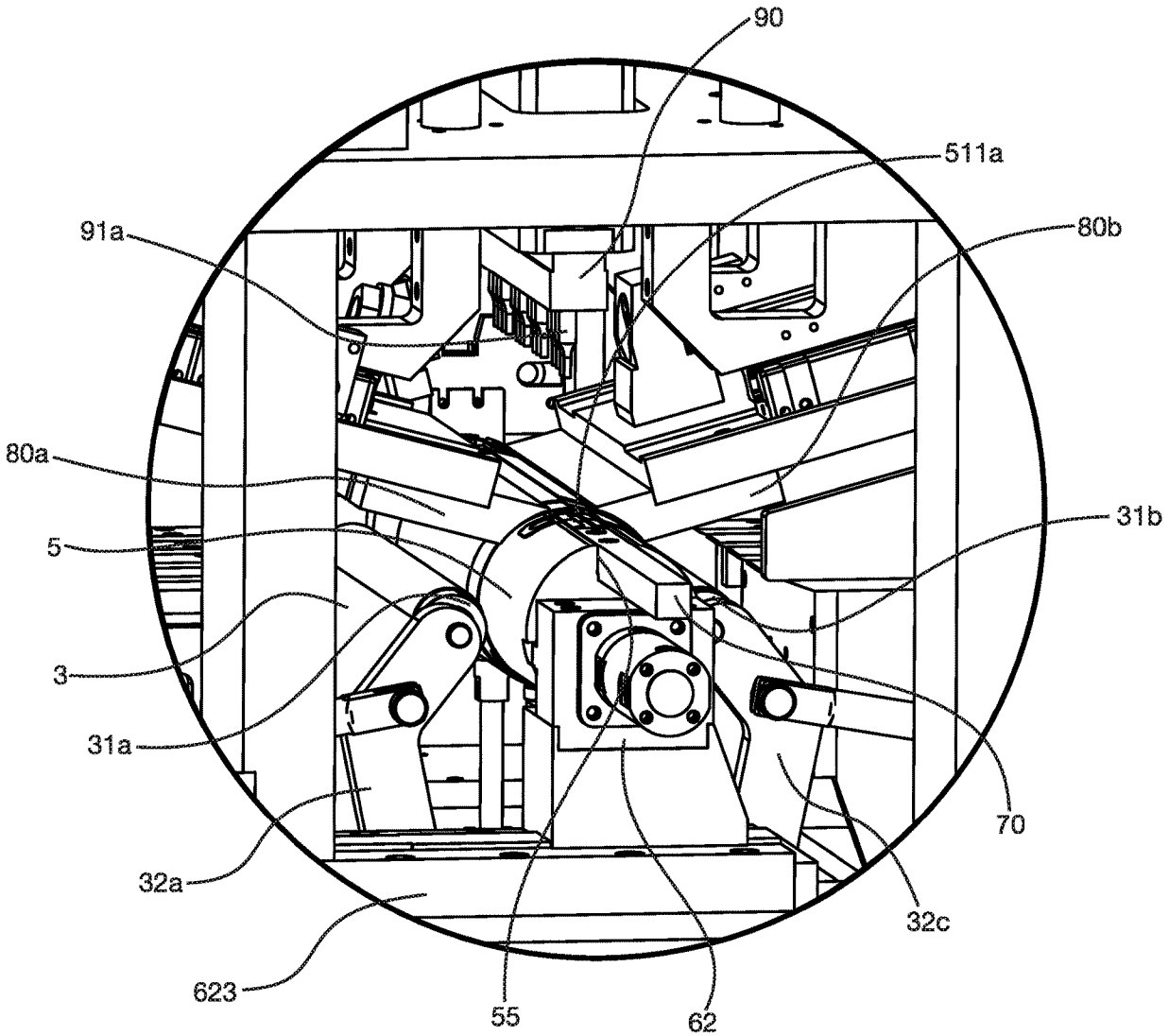
FIG. 3 is a partial side perspective view depicting the second side wiper forming the second edge of the sheet metal blank over the first edge held by the first side wiper as shown in FIG. 2.
Figure 4:
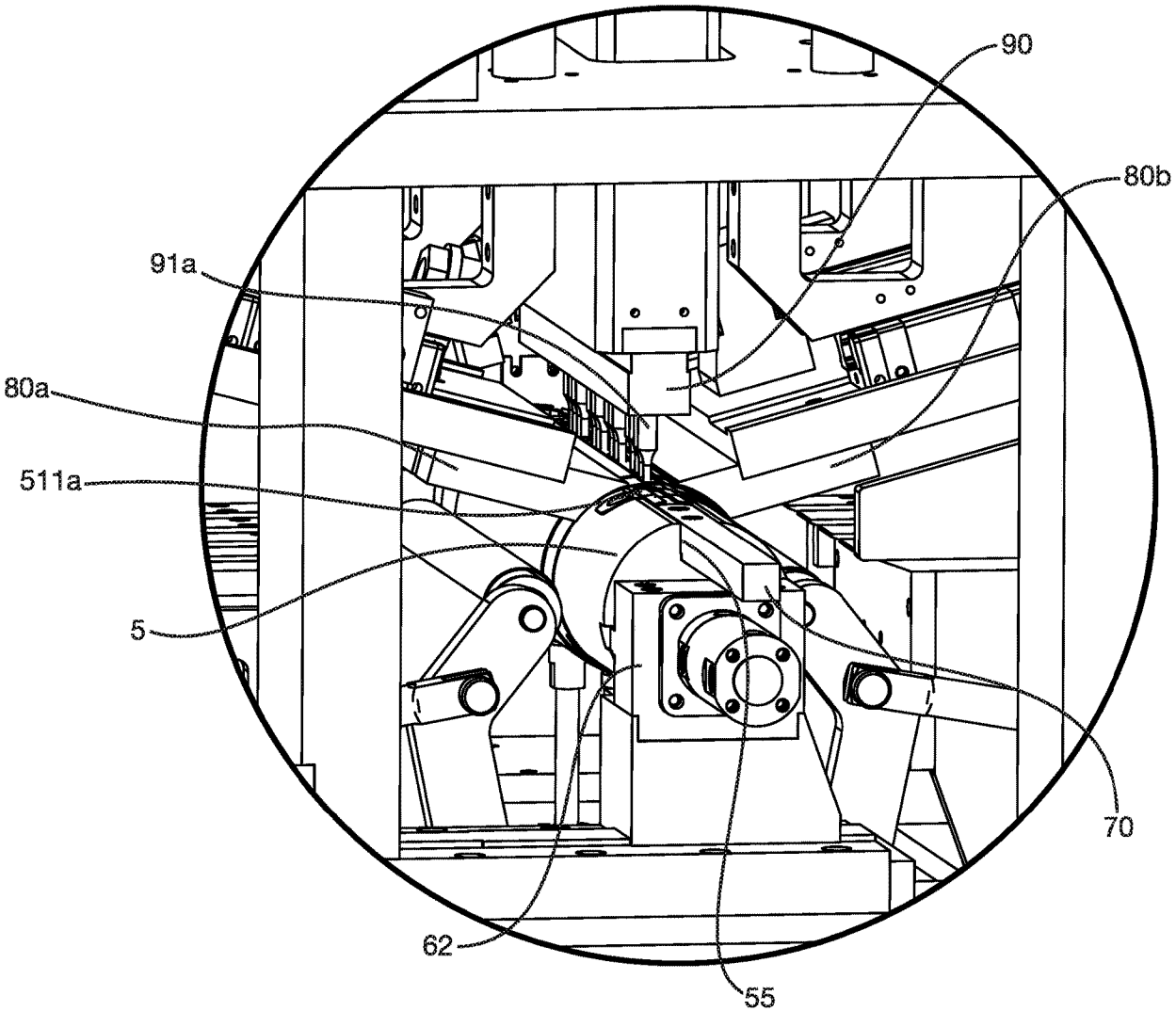
FIG. 4 is a partial side perspective view depicting the clinching punch interfacing with the sheet metal blank and the underlying die buttons to form clinch structures.

Immediately after the upper edge of the sheet metal blank (III) has been forced over the lower edge of the blank (as depicted in FIG. 3), a clamping bar (90) is lowered over the overlapping area to hold the two overlapping edges in place (see, FIG. 4). This operation ensures that the two edges of the sheet metal blank (III) are firmly held together in place without deformation or loosening. The tight hold of the clamp bar (90) also helps to assure precision of the subsequent clinching step (see, FIG. 5).

Within the mandrel (5), a stepped gag bar (52; controlled by control bar 522 best seen in FIGS. 28 and 29) is operated to raise a clinching die bar (51) into position immediately beneath the lower edge of the overlapping sheet metal blank edges (FIG. 4). The die bar contains a number of clinching die buttons (511(*a*), (*b*), (*c*) . . . (n); seen in FIGS. 28 and 29) arranged in a particular pattern for clinching together the two overlapping edges of the sheet metal blank (III). When the die bar (51) is raised, the die buttons (511(*a*) . . . (n)) are aligned in the proper position for an effective clinching operation. Because the two edges of the sheet metal blank are tightly held down by the clamping bar (90), the movement of the clinching die bar (51) does not disturb and/or shift the sheet metal edges.

Figure 5:
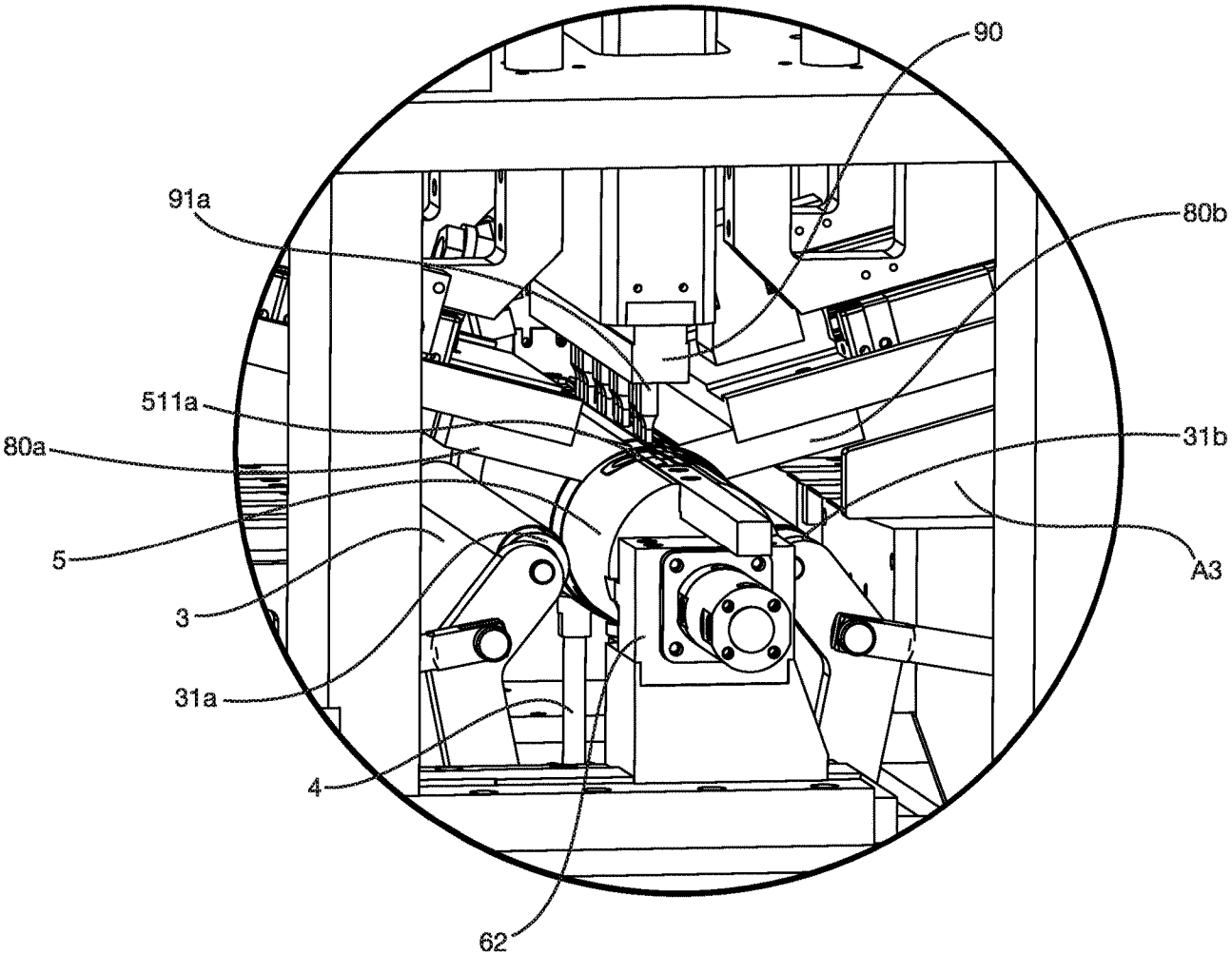
FIG. 5 is a partial side perspective view depicting the clinching punches interfacing with lower clinching die buttons.
Figure 28:
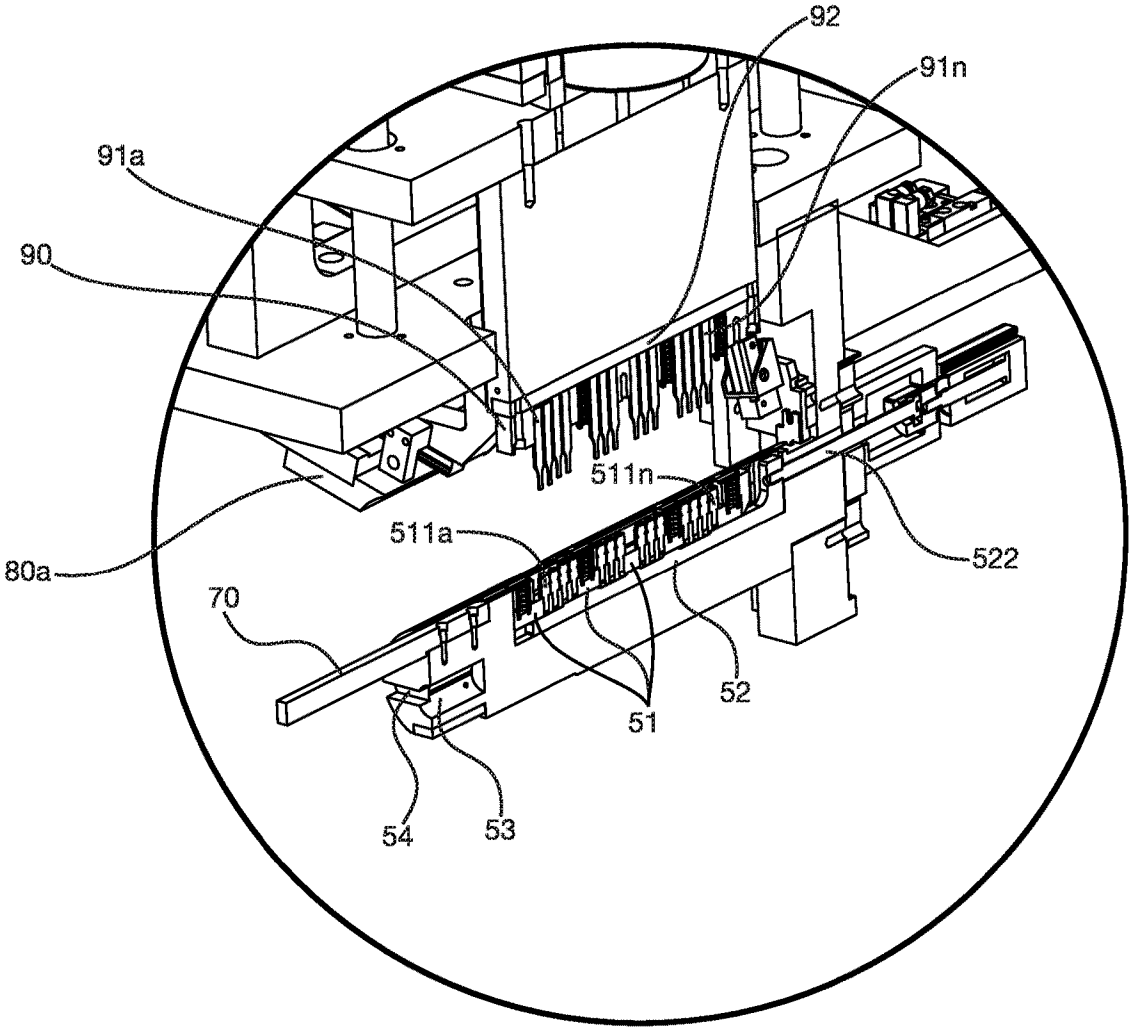
FIG. 28 is a partial-sectional view of the mandrel and the clamping bar positioned above the mandrel, depicting a cross-section of the clinching components.

As depicted in FIG. 5, with the buttons dies (511(*a*) . . . (n)) of the clinching die bar (51) in place, punches (91(*a*), 91(*b*), 91(*c*) . . . 91(*n*)) are extended through the clamp bar (90), and into the material of both of the sheet metal edges of the blank (III) in a standard clinching operation to form a series of clinches VI(a),(b),(c) . . . (n). With reference to FIG. 28, the position of the punches (91(*a*) . . . (n)) corresponds in mating relationship to that of the die buttons (511(*a*) . . . (n)) in a preselected clinching pattern (seen in FIGS. 7 and 9) required for the end product/finished tube (IV).

Once the clinching operation has taken place, the punches (91(*a*) . . . (n)) are withdrawn through the clamping bar (90) (using gag bar (92), as depicted in FIG. 28, to raise or lower the punches (91(*a*) . . . (n))), as depicted in FIG. 5. Although not shown, during this time the clamping bar (90) remains tightly in place to make certain that none of the material that has been clinched is deformed with the withdrawal of the punches. This is crucial to making a clean clinch at each die location. Otherwise, the withdrawal of the clinching punches (91(*a*) . . . (n)) would tend to disfigure and/or distort the material of the sheet metal that has been stamped in the clinching dies (511(*a*) . . . (n)). The result is a clean, undistorted and strong connection between the two edges of the blank formed in a finished tube. The clamp bar (90) remains in place until the beginning of the tube (IV) extraction process step discussed next.

Figure 6:
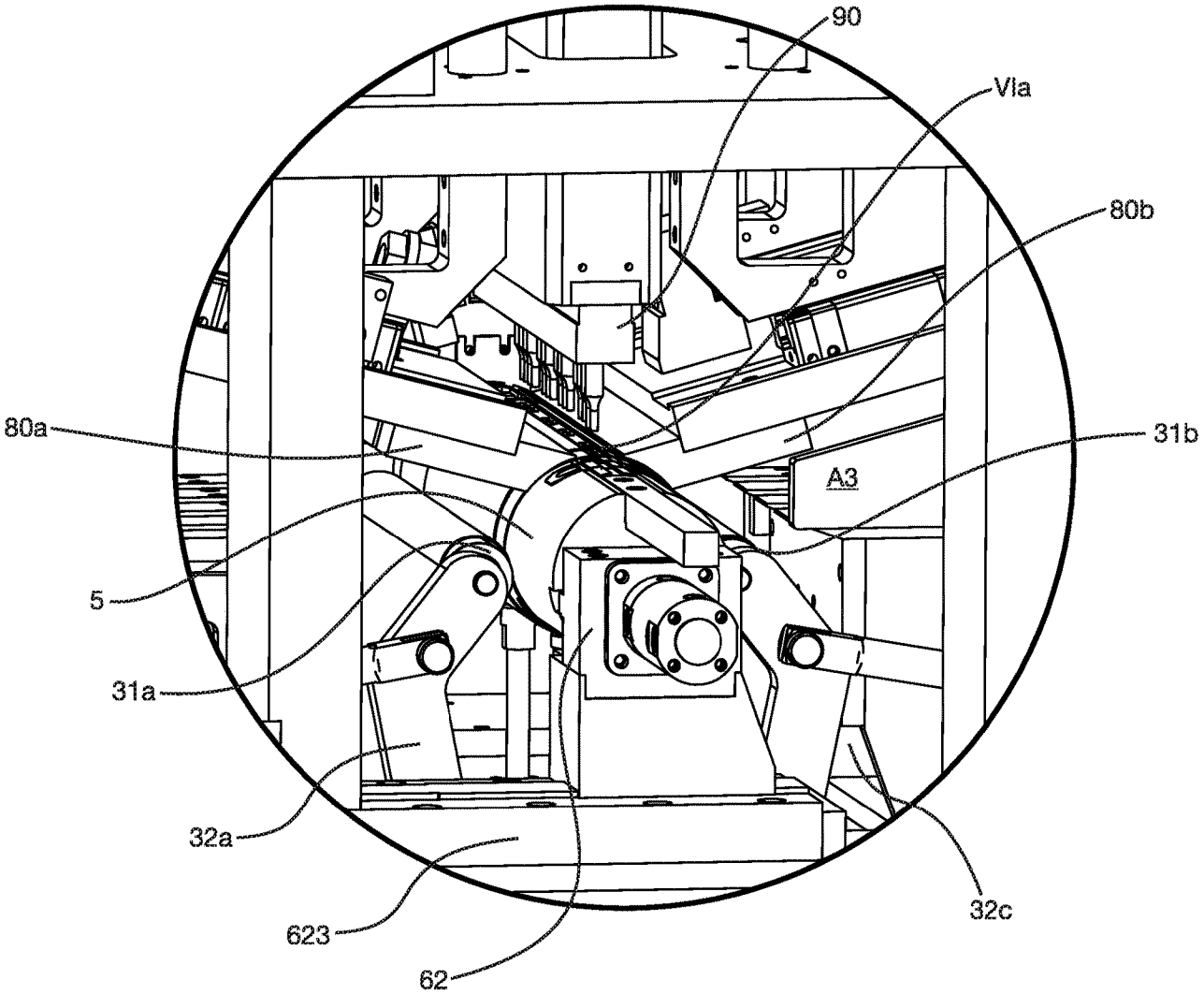
FIG. 6 is a partial side perspective view depicting the clinch bar and the clinching punches of FIG. 5 being raised away from the overlapping sheet metal edges.
Figure 7:
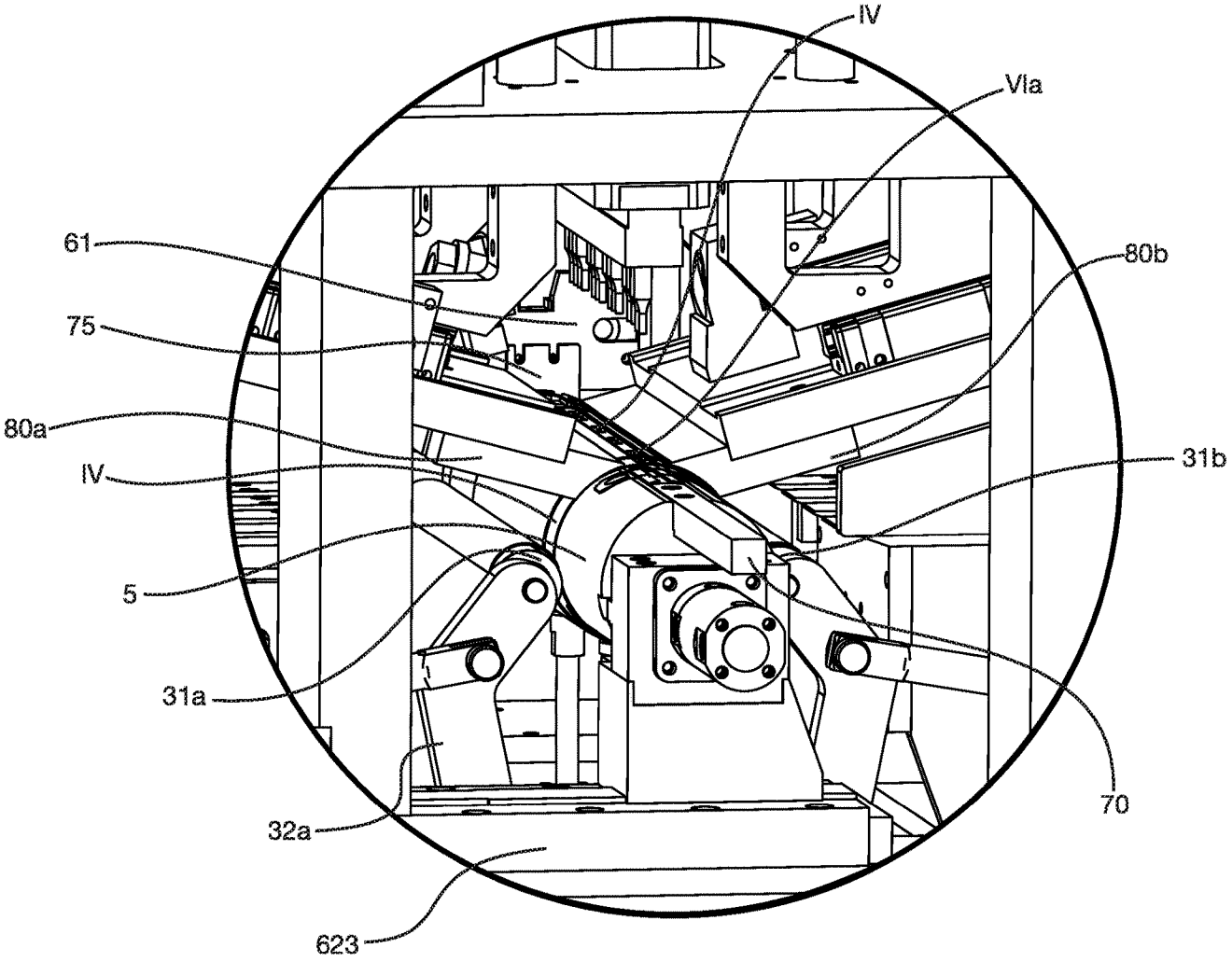
FIG. 7 is a partial side perspective view depicting the clinching pattern arranged along the length of the finished tube.
Figure 8:
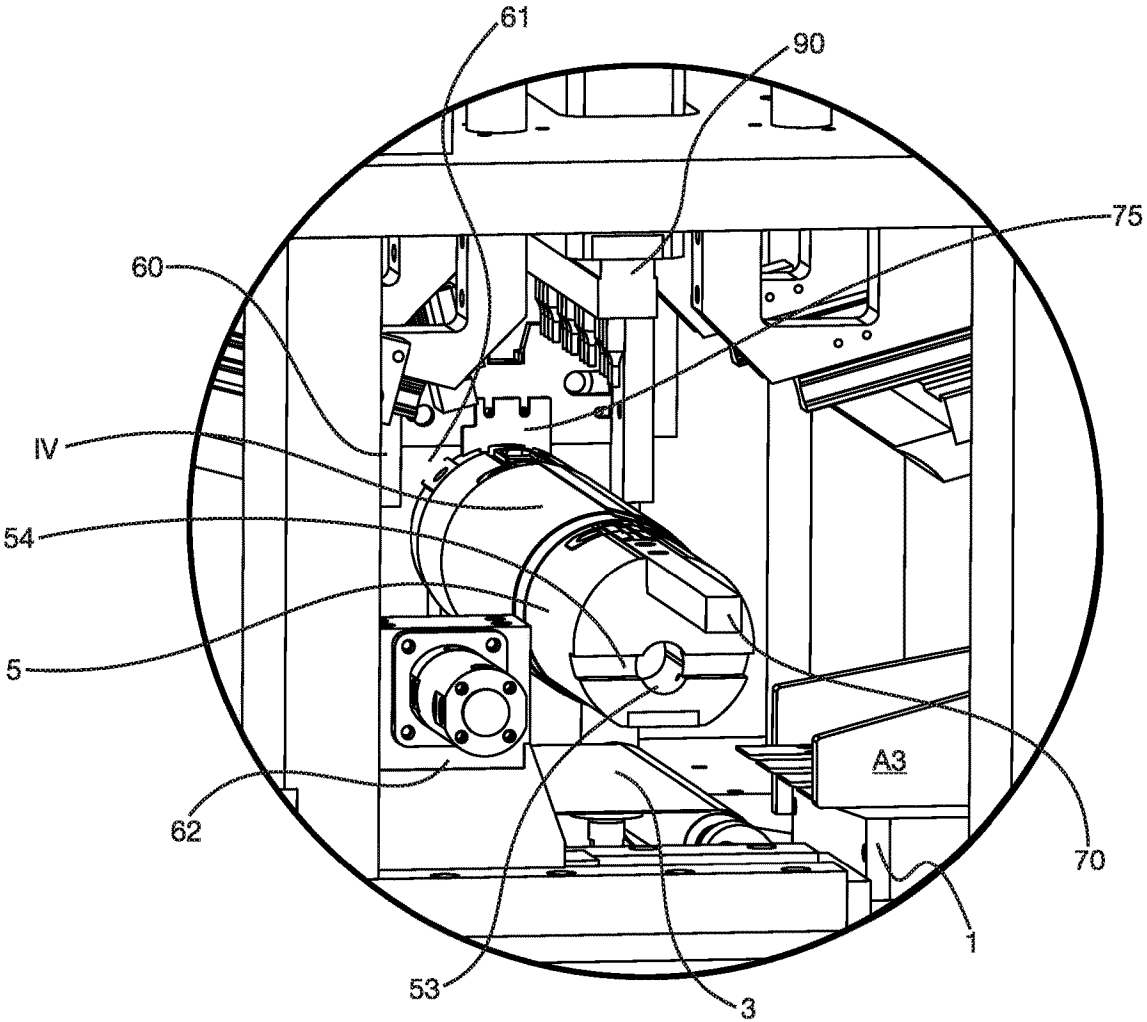
FIG. 8 is a partial side perspective view depicting the formed sheet metal tube on the mandrel as shown in FIG. 7, but with the mandrel open-end holding arrangement shifted away from the open-end of the mandrel.
Figure 16:
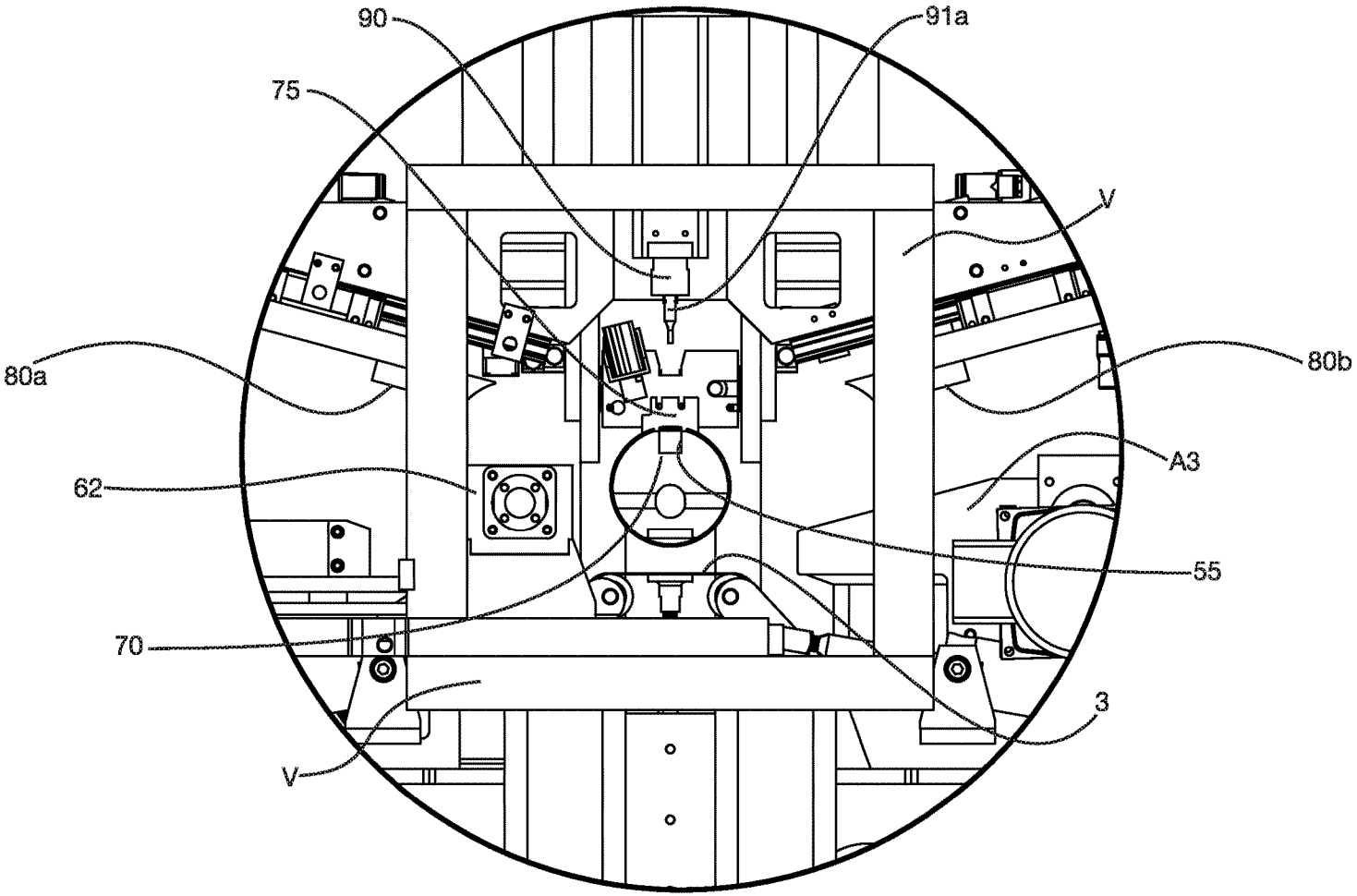
FIG. 16 is a partial detailed end view of the mandrel with the open-end mandrel holding device moved away from the mandrel, as shown in the view of FIG. 15.
Figure 17:
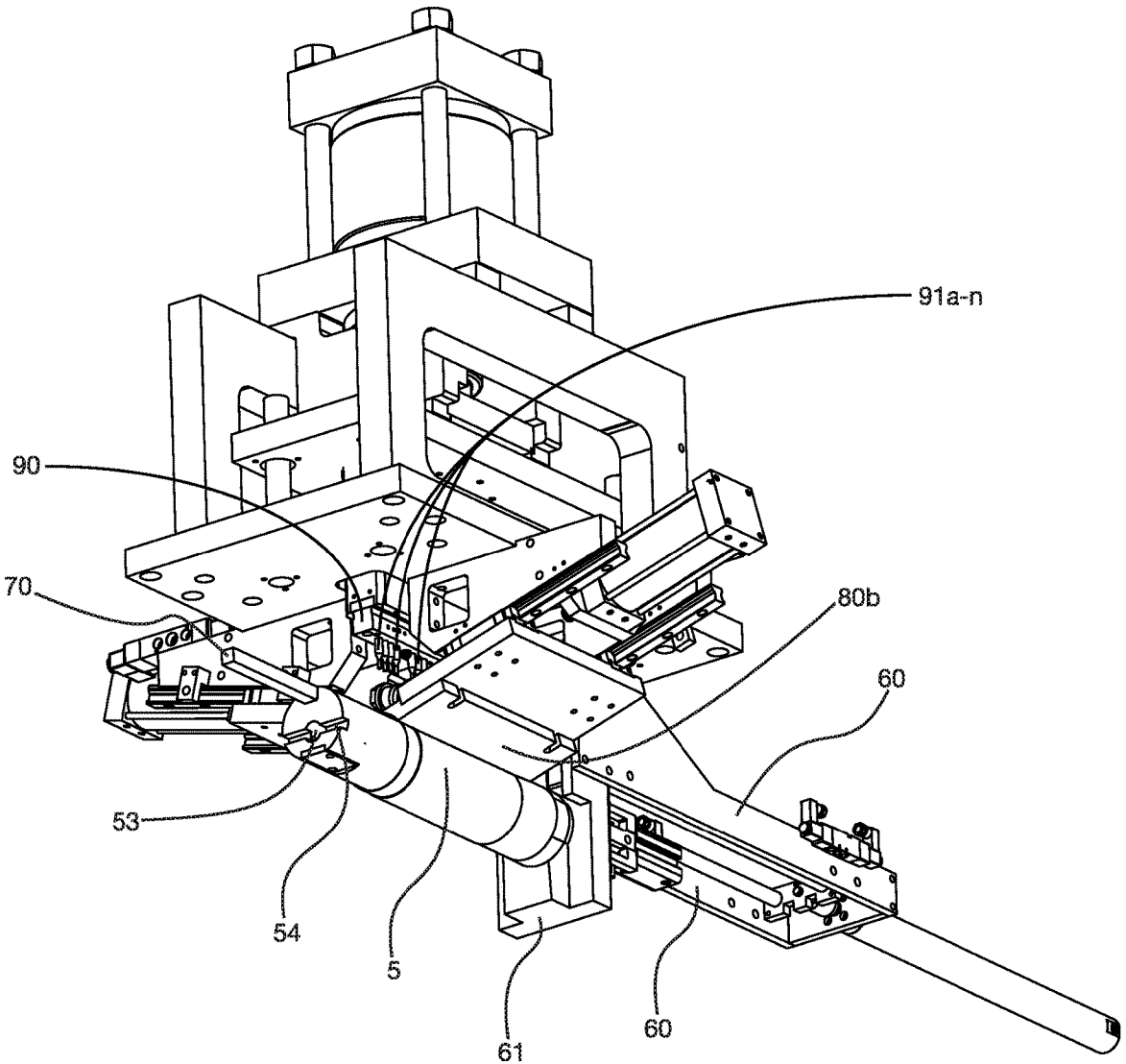
FIG. 17 is a bottom perspective view of the details of the mandrel with the mandrel holding device moved away from the mandrel and a product extraction support bar in an extended position to hold a finished tube that has been moved off the mandrel.
Figure 18:
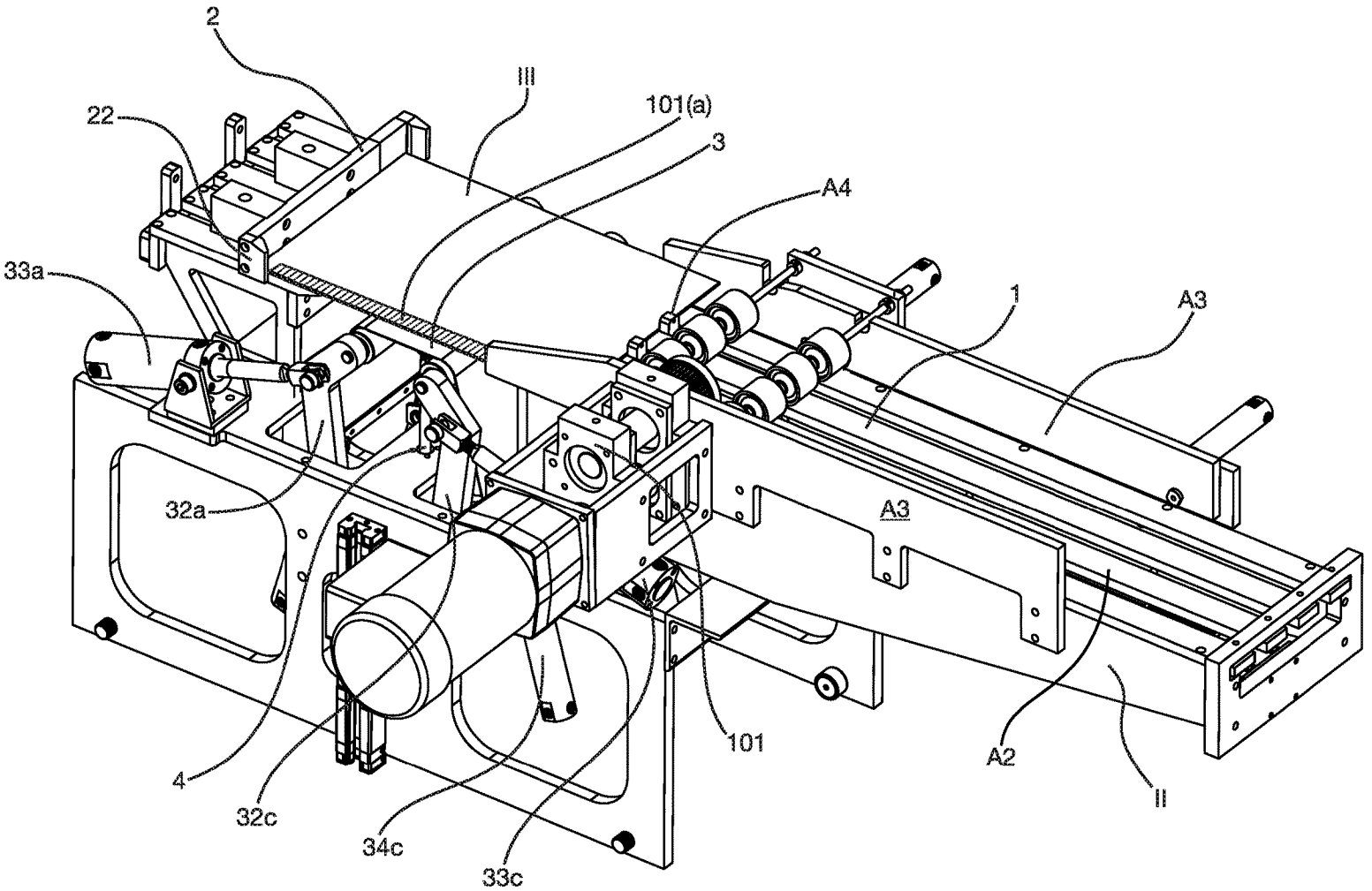
FIG. 18 is a perspective view from the top and side showing the feeding unit and the strap wrap mechanism.
Figure 23:
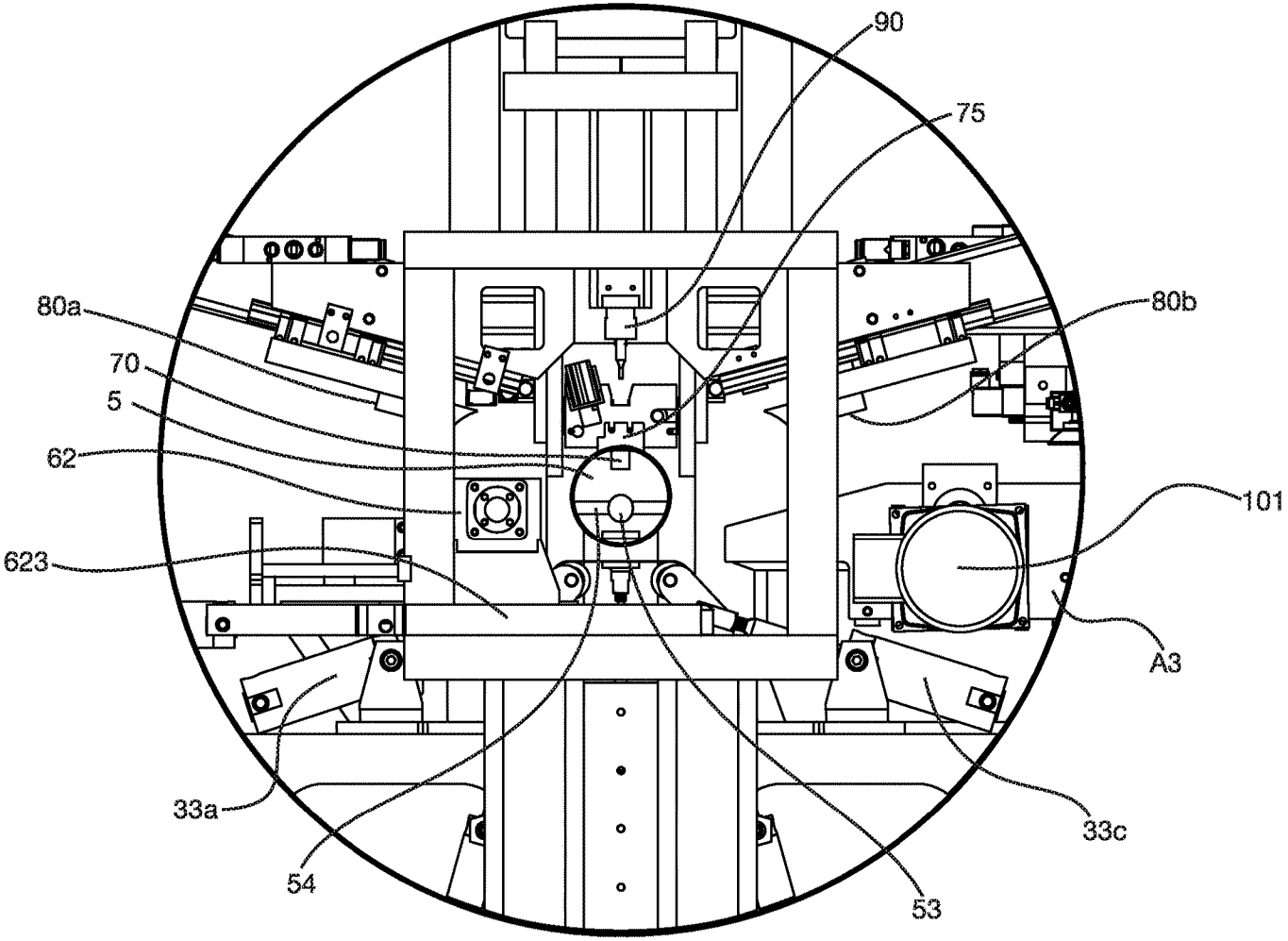
FIG. 23 is a side view of FIG. 22.
Figure 24:
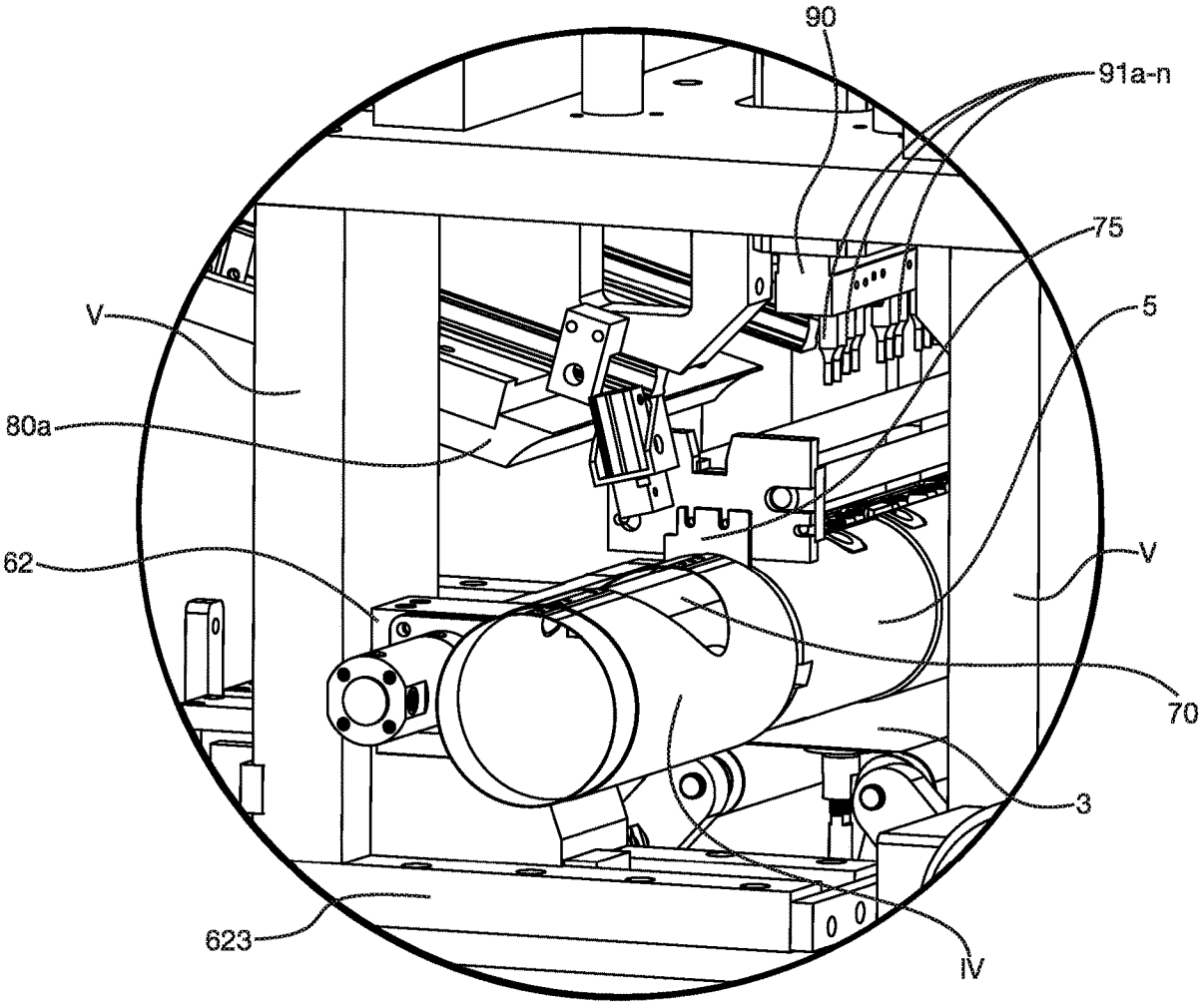
FIG. 24 is a perspective view of the mandrel during the tube extraction process with the cut-away in the tube as illustrated in FIG. 22 to show the extraction bar.

Once clamping bar (90) has been withdrawn, as depicted in FIG. 6, the extraction process step of the finished tube (IV) can begin. To facilitate all necessary aspects of this operation, clamping bar (90) is raised, as depicted in FIG. 7 so as to permit stripper plate (75) a clear range of operation along the length of the mandrel (5). Further, wiper plates 80(*a*), 80(*b*) are entirely withdrawn, as depicted in FIG. 8. The withdrawn position of the wiper plates is also depicted in FIGS. 16, 23 and 24. Like with the clamping bar (90), the raised positioning of the wiper plates is such as to allow a full range of motion for stripper plate (75) to carry out the removal of the finished tube (IV) from mandrel (5). The positioning of the clamping bar (90) and wiper plates (80(*a*), 80(*b*)) in the withdrawn positions is crucial for the automatic removal of finished tubes IV.

Because of the high level of forces applied to the sheet metal blank (III) and the mandrel 5 (from the strap wraps (3), pressure pads (42), wiper plates (80(*a*), 80(*b*)), and clamp bar (90)), the mandrel (5) must be firmly secured and supported in place at both ends. This is not necessary in the conventional art since the conventional systems do not form the tube and carry out the clinching process on the same mandrel. Accordingly, in the conventional art, only one end of the mandrel needs to be firmly supported. In those cases, the other end of the mandrel is allowed to "float". The "open" or "floating" end of the mandrel is also preferred in the conventional art, so as too easily remove the finished tube that would have been manually clinched (also not rolled and firmly held to form on the same machine as with the instant invention).

The present invention is entirely different from conventional systems. In this case, both ends of the mandrel (5) have to be firmly supported by a robust structure (60), as seen for example in FIGS. 1, 7 and 10, including fixed end support (61), and open-end mandrel holding arrangement (62), so that the substantial forces described above can be exerted to form and clinch the sheet metal tube (IV) without distorting the position and integrity of the mandrel after repeated cycles of use. The fixed end of the mandrel is supported and firmly attached to the frame (V) at fixed end support (61), supported in turn by structure 60 and the entire integrated frame of the tube forming system (I). The fixed end mandrel support (61) must be capable of rigidly holding the mandrel when the holding arrangement (62) at the other end of the mandrel is removed during the operating cycle as seen in FIG. 8. To be clear, this is necessary at those times when a finished tube (IV) is being ejected from the mandrel using stripper plate (75). Further, when mandrels (5) are changed, it is necessary that a robust mounting structural support (60) be provided so that the mandrel can be reliably and permanently held at only one end at (61). The fixed end mandrel support (61) is relied upon for this function, and so must be mounted upon the framework (V) that supports the other fixed parts of the overall system (I).

As previously stated, it is a necessary aspect of the present invention that both ends of the mandrel (5) be firmly held (when, for example, the sheet metal blank (III) is forced over the mandrel (5) and during the subsequent clinching steps) to resist any movement, that would likely result in inaccuracies and imperfections being translated to the finished sheet metal tube (IV). Therefore, the end of the mandrel (5) opposite the fixedly supported end has to be capable of being opened during the cycle so that the finished tube (IV) can be removed (see, for example, FIGS. 7 and 8). This is accomplished in the present invention with a sliding mount (623) arranged on the framework (V) that supports the present system. With reference to FIGS. 26-29, this open-end mandrel holding arrangement (62) includes a pneumatically (or hydraulically) driven pin (621) that extends into aperture (53) deep within the body of the mandrel (5) in order to keep the mandrel from moving horizontally. Also included is a horizontal plate (622) that fits into a mating slot (54) across the diameter of the mandrel. This structure keeps the mandrel from moving vertically. The entire holding structure is driven by a pneumatic cylinder used to withdraw mandrel holding arrangement (62) along sliding mount (623) (i.e., moving from the hold position shown in FIGS. 7, 26 and 27 to the open position shown in FIGS. 8 and 15), which is activated when the clinching process is complete (i.e., the clamp bar (90) and the wiper plates (80(*a*), 80(*b*)) withdrawn as depicted in FIG. 7).

Once the open-end holding arrangement (62) of the mandrel (5) has been slid out of the way as depicted in FIG. 8, the finished sheet metal tube (IV) can be released from the mandrel, to be moved to other (external) workstations for further processing (such as that used in an elbow machine). However, there are certain attributes of the present system that must be addressed in order to maintain efficiency of operation. In particular, the tightness of the tube (IV) formed over the mandrel (5) can lead to difficulties in extracting the tube from the mandrel. Accordingly, because precise tolerances used in the manufacture of the finished tube are often preferred and/or required, a special accommodation for tube release is needed in the preferred embodiment of the machine/system (I).

This release and removal step is accomplished in a number of ways. Firstly, there is a slight taper to the mandrel (5) of between approximately 0.035-0.045 inches from the fixed end (at support 61) of the mandrel to the open-end holding arrangement (at structure 62) of the mandrel. This slight difference in mandrel diameter permits easier movement from the fixed end (at 61) to the opposite end (at 62) when extracting the finished sheet metal tube (IV) from the mandrel (5).

Figure 22:
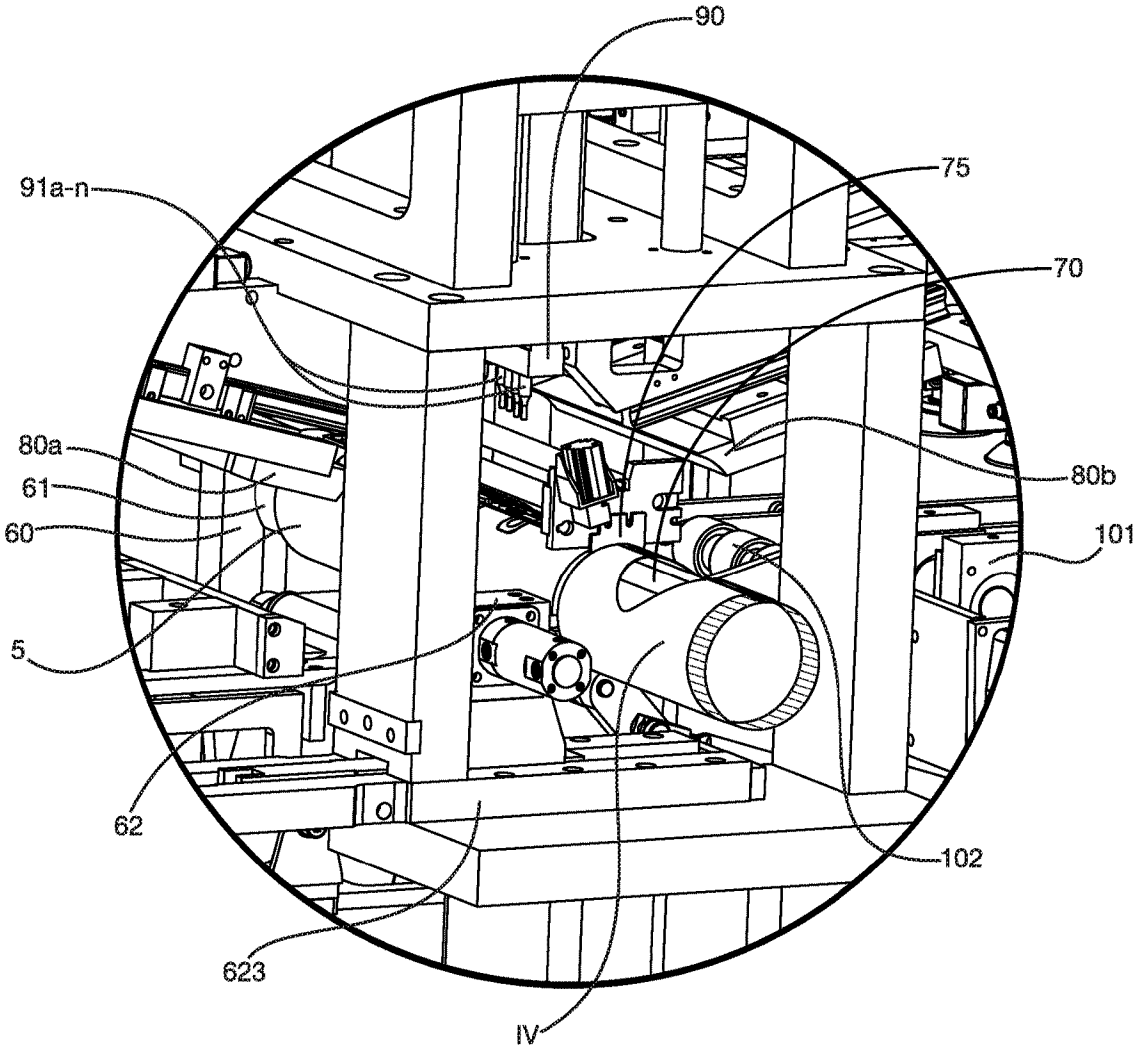
FIG. 22 is a perspective view of the of the mandrel and surrounding components of the system with the open-end mandrel holding device moved away from the mandrel (as in FIGS. 15 and 16) with a formed tube moving off the mandrel to be extracted from the system as shown in FIG. 9 but with a cut-away in the formed tube to show an extraction support bar.
Figure 25:
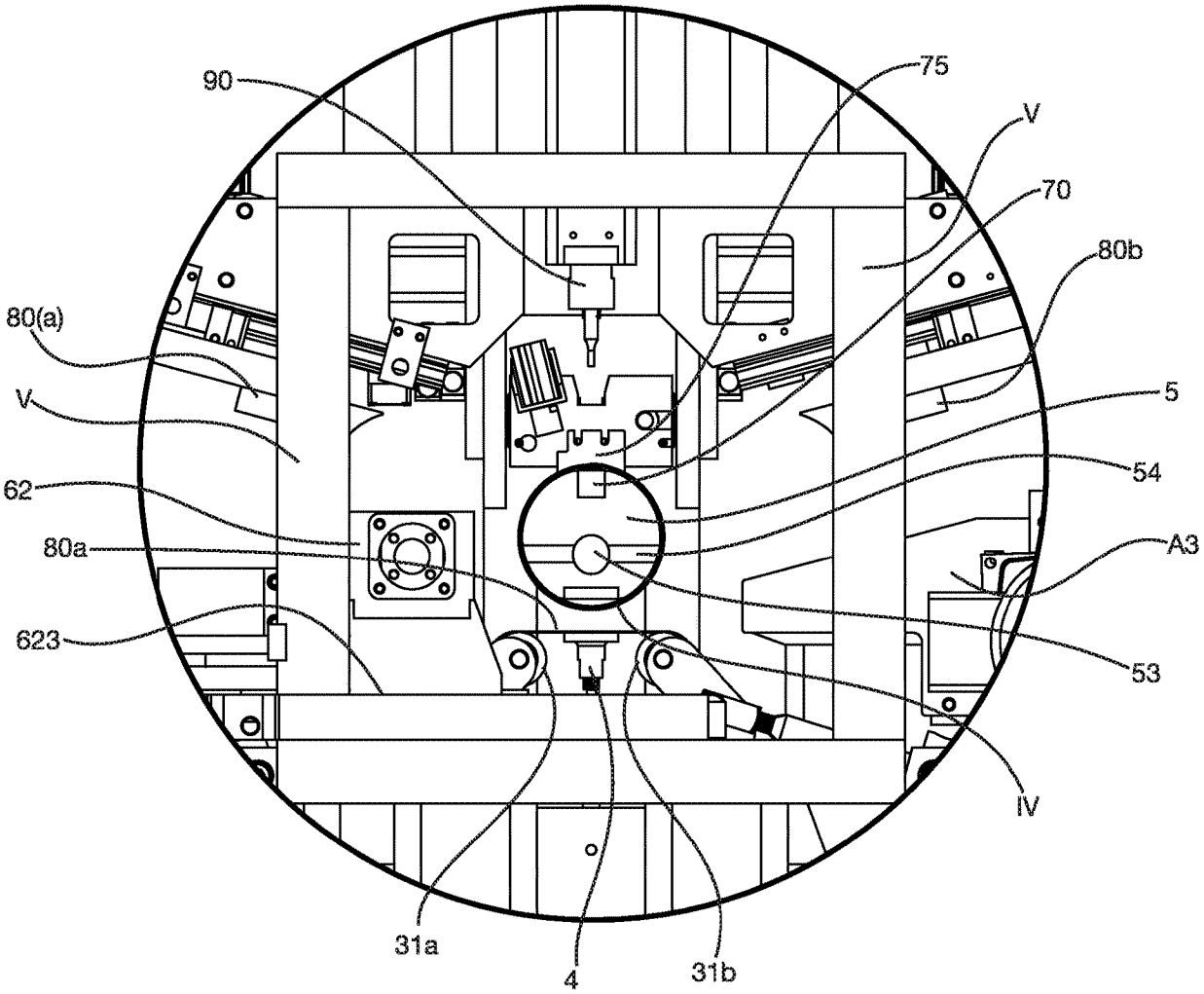
FIG. 25 is a side view of FIG. 24.
Figure 26:
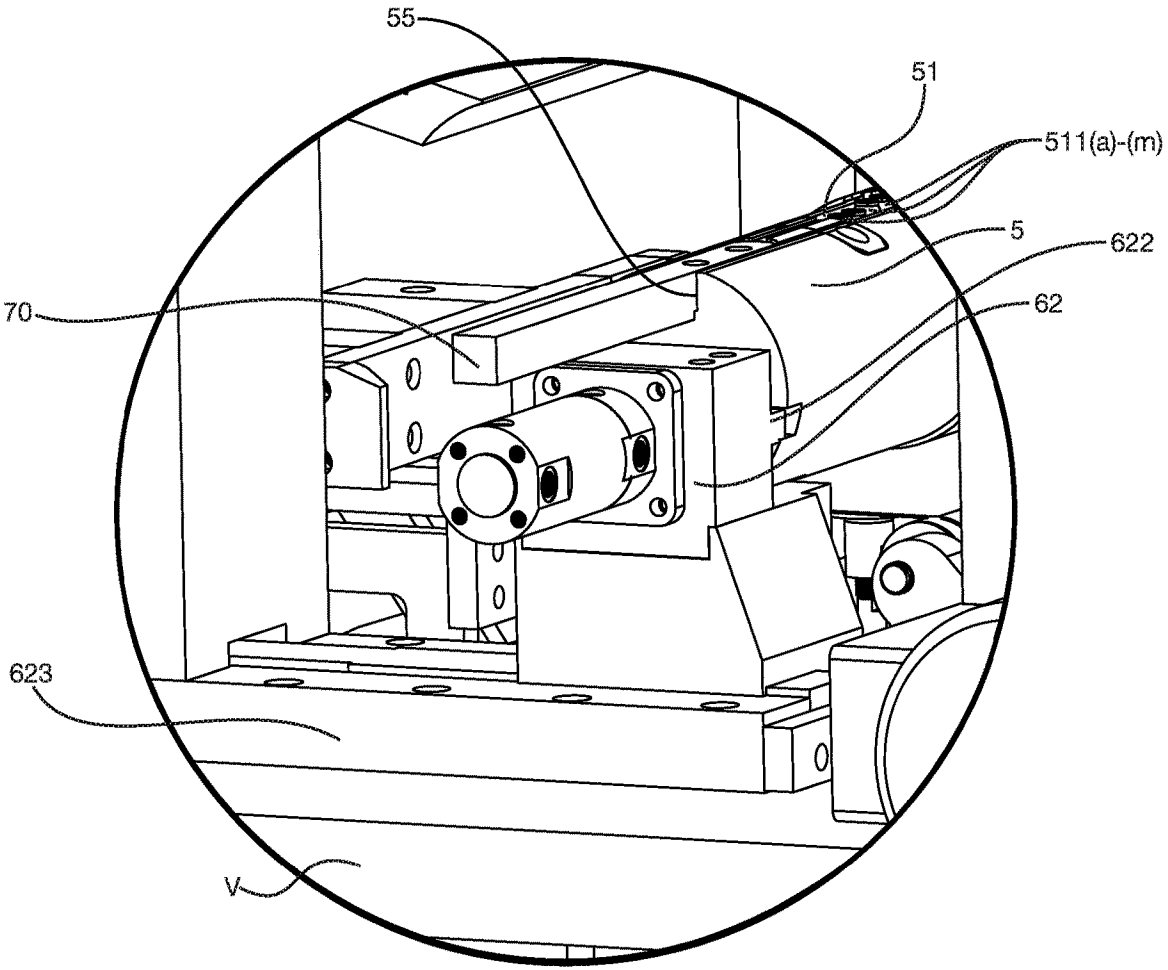
FIG. 26 is a perspective view of the sliding holding arrangement in position (i.e., holding) the open-end of the mandrel.
Figure 27:
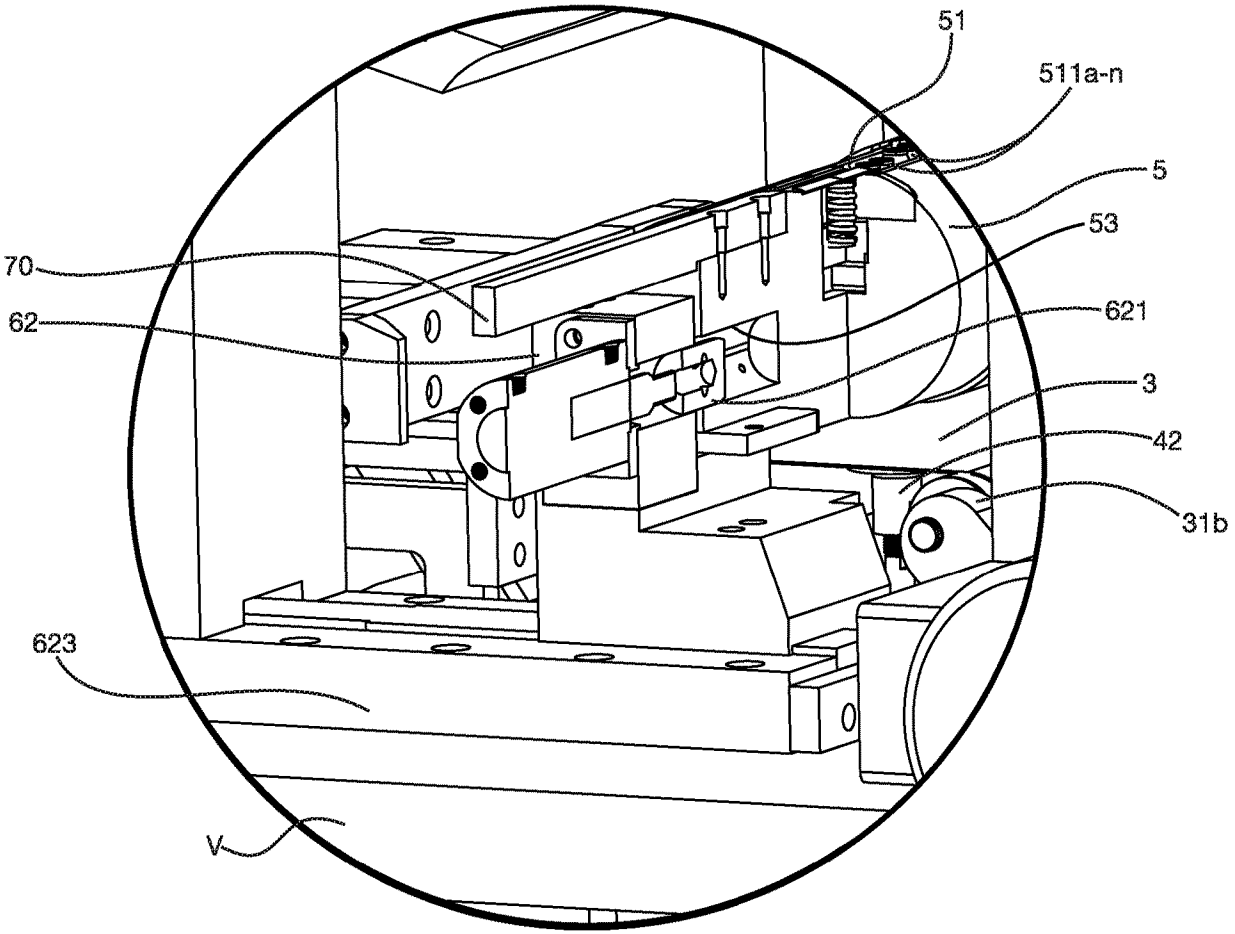
FIG. 27 is a sectional view of FIG. 26, depicting a support pin from the sliding holding arrangement fitted and engaged into the open-end of the mandrel for holding the mandrel during the clinching step of the tube forming operation.
Figure 29:
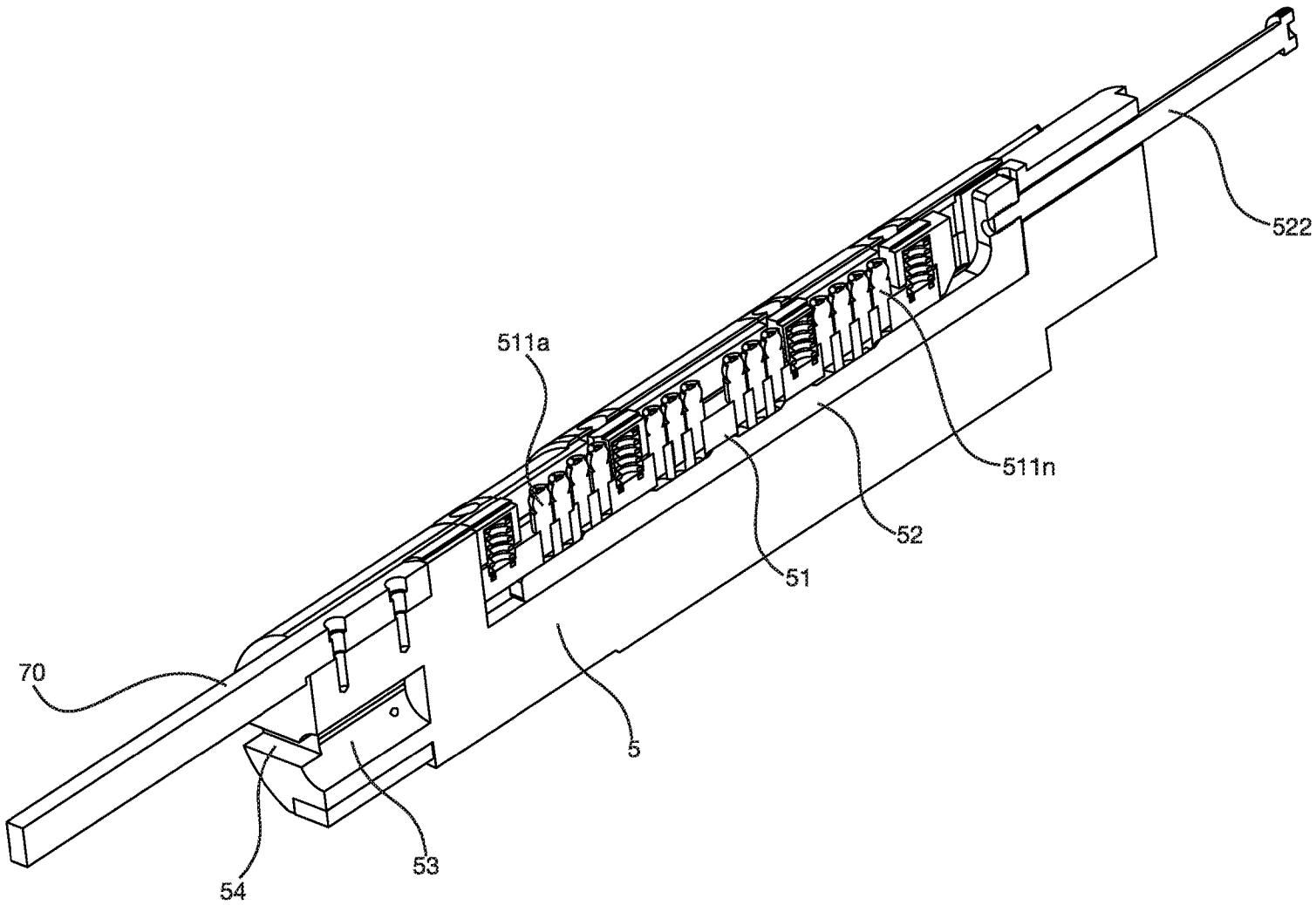
FIG. 29 is a sectional view of only the mandrel and clinching components therein shown in FIG. 28.

Further, the gag bar (52) seen in FIGS. 28 and 29, beneath the clinching die bar (51) within the mandrel (5), operates so that the clinching die bar (51) is lowered once the clinching operation is complete, and the clamp bar (90), seen in FIGS. 22, 23 and 25, is raised. This operation provides a slight measure of separation between the area of clinching along the length of the sheet metal tube (IV) and the mandrel (5).

The chief structure for removing the finished sheet metal tube from the mandrel (5) is a stripper plate (75) arranged on the fixed side of the mandrel beyond the length of the sheet metal tube (IV). The stripper plate (75) is preferably semicircular, partially curving around the diameter of the mandrel (5) and arranged sufficiently close thereto to interface with the finished sheet metal tube (IV) while sliding over the surface and along the length of the mandrel (5). Once the open-end holding arrangement (62) of the mandrel is slid away from the mandrel, the stripper plate (75) is activated to slide the finished sheet metal tube (IV) off the mandrel (5).

However, the rapid movement of the operation of the stripper plate (75), along with the relatively thin length of the sheet metal tube (IV), presents the additional problem of tube movement/fall and possible deformation during the extraction process. More specifically, the finished tube (IV) can rotate slightly as it is being removed from the mandrel (5). This can cause damage to the finished tube or interference to the operation as the finished tube is being pushed by the stripper plate (75). This problem is addressed through the use of a product extraction support bar (70) extending from the open-end of the mandrel (5) at, or near, the upper apex of the mandrel. Consequently, the bar (70) extends beyond and above the space in which the sliding mandrel holding arrangement (62), accommodating the open-end holding arrangement of the mandrel, would be when the mandrel is supported accordingly. The support provided by the product extraction support bar (70) acts as a guide and prevents any type of bending, fall, rotation or warpage of the finished sheet metal tube (IV) when it is being forcefully extracted from the mandrel (5) by the stripper plate (75). Further, since the forward-most end of product extraction support bar (70) extends some distance from the mandrel (5), and above the open-end mandrel holding arrangement (at 62), there is sufficient space for external robotic moving or receiving mechanisms to take the finished sheet metal tube (IV) away from the subject invented system (I) and onto another downstream processing station.

The rapid rolling and clinching of sheet metal blanks (III) by the present invention (I) fully facilitates rapid robotic feed (from external blank cutting systems), and rapid robotic removal of the finished sheet metal tubes (IV) (by any number of external devices). Further, the product extraction support bar (70) can be easily removed from longitudinal slot (55) in mandrel (5) and replaced with a support bar (70) having a length and width that works best to accommodate the various lengths and/or diameters of the different finished tubes (IV) being removed from the mandrel (5). Further yet, the easy connection of the product extraction support bar (70) to mandrel (5) allows rapid changing of mandrels by simply sliding aside the open-end mandrel holding arrangement (at 62) on the slide (620), releasing and clearing any finished tube (IV) with its clinched connections (VI(a),(b),(c) . . . (n)) to the product extraction support bar (70) extending from the longitudinal slot (55), and then disconnecting the mandrel (5) from the fixed mandrel support (at 61). It is important to note that the wrap strap (3) accommodates easily to a wide range of different mandrel diameters.

Preferably, pneumatic cylinders and conventional position detectors are used in the moving and forming of the sheet metal blanks (III). This maintains the efficient operation of the present system, utilizing between 30 and 40 amps (as opposed to hundreds of amps for laser welding machines). The compact design of the present integrated tube forming and clinching system (I) saves space on the factory floor and allows for easy integration with various types of feeding units (II) and postproduction handling of the sheet metal tubes (IV) produced by the present system. It should be understood that hydraulic or electric motivators can be substituted for the pneumatic cylinders.

It should also be understood that the present system allows multiple clinching operations to take place on the same tube, and the system facilitates a wide variety of different clinching patterns. Accordingly, customers can specify the precise clinching arrangement on the tube in order to facilitate future applications of the resulting tubes. Moreover, a variety of mandrels (5), and clinching die bars (51) can be built to accommodate a wide variety of tube blanks (III) and clinching patterns. Further, tubes (IV) are easily positioned at various locations along the mandrel (5) using a variety of different means. One example would be the use of the stripper plate (75) to move the tube (IV) along the mandrel (5) for a second clinching or different operation on the outside of the tube.

Another advantage of the present invention is that the holding arrangement (62) at the open-end of the mandrel (5) is easy to maintain and the connection (61) at the fixed end is such as to allow the mandrel to be easily changed in order to change the diameter of the finished sheet metal tube. Likewise, clinching die bar (51) and its die buttons (511) are located near the surface of the mandrel and can be easily rearranged or exchanged in order to modify the clinching diameter, strength, pattern and/or impact.

Figure 12:
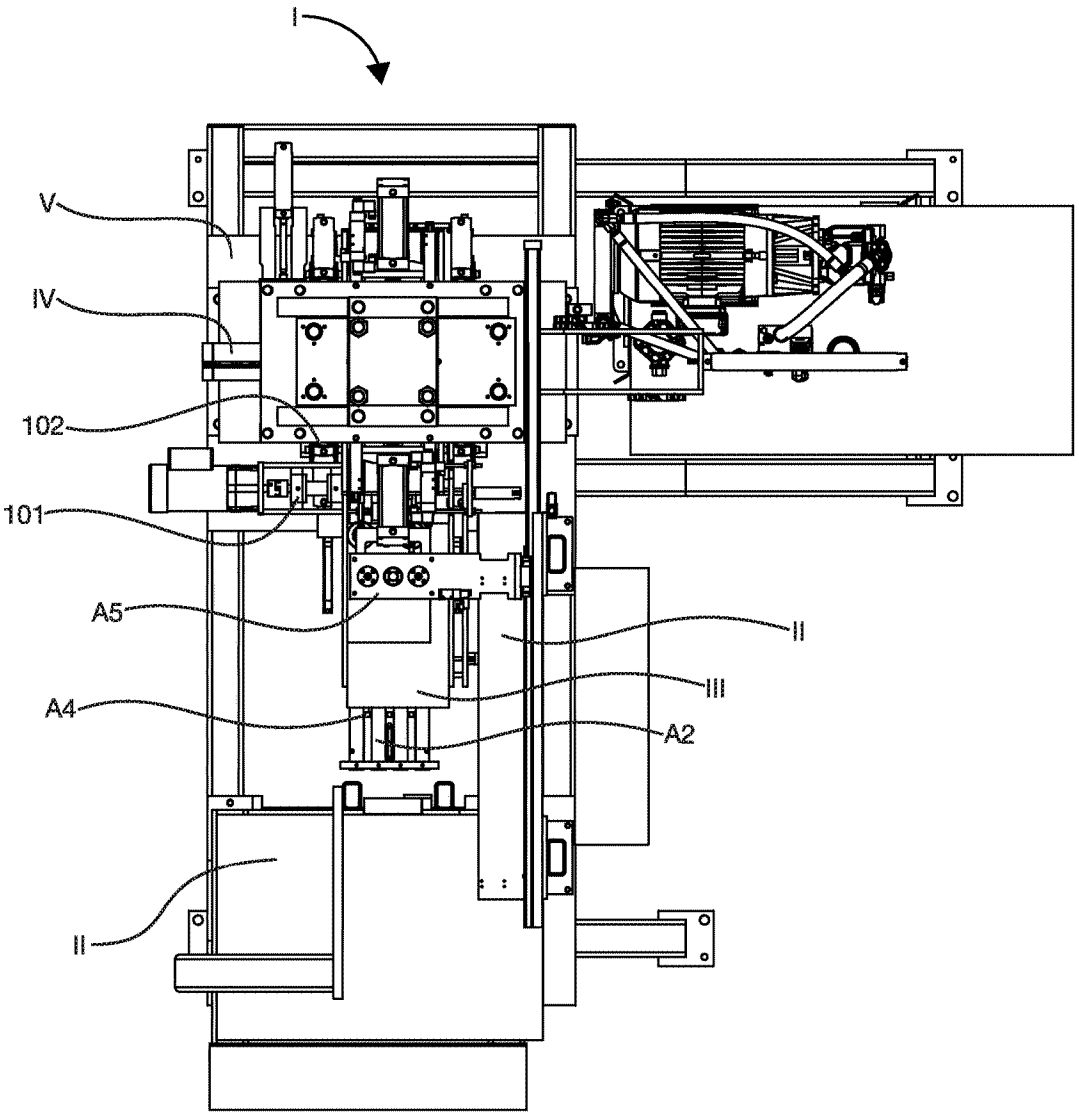
FIG. 12 is a top plan view of the subject tube forming and feeding unit of FIG. 10.
Figure 13:
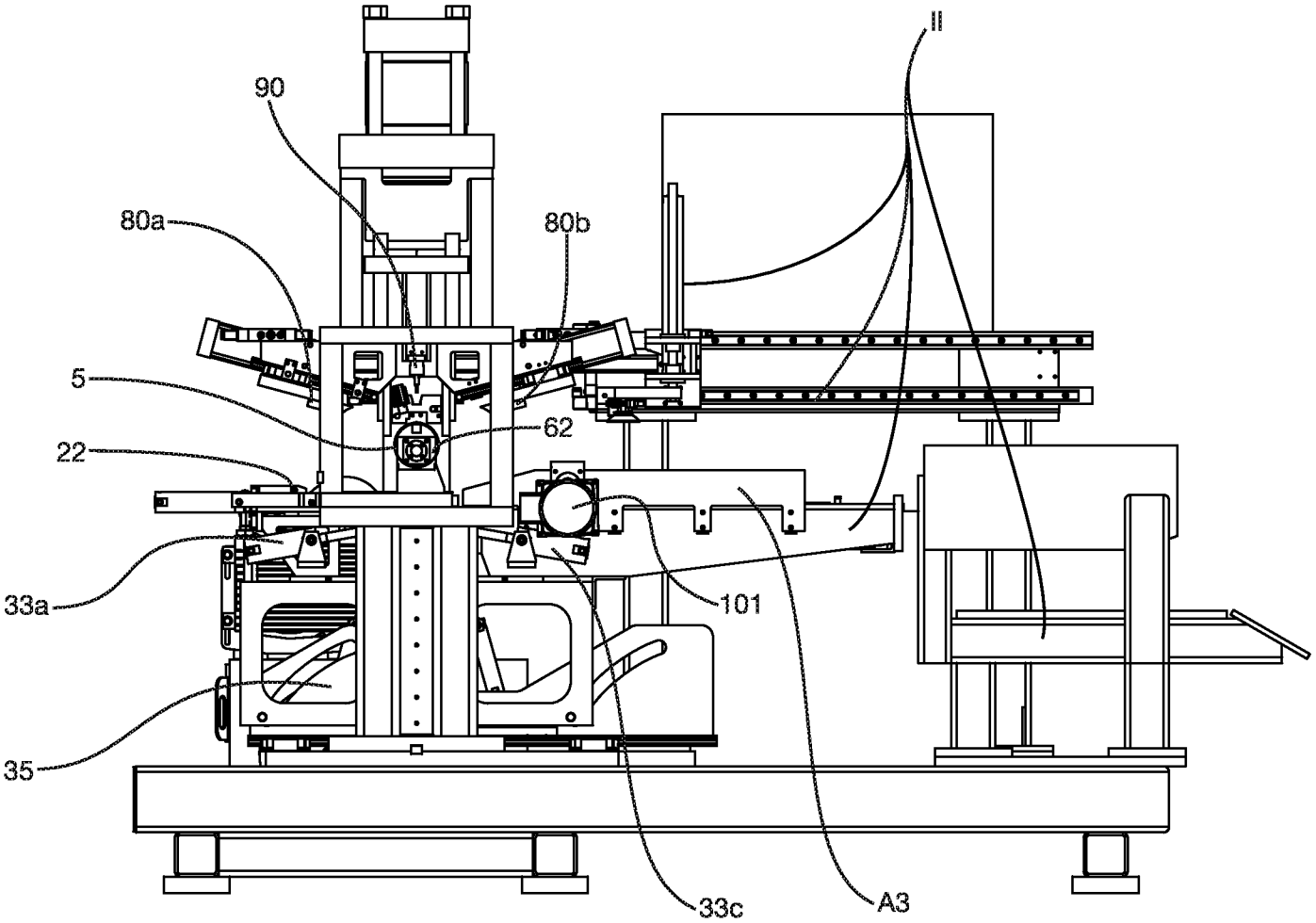
FIG. 13 is a side elevational view of the subject tube forming system with the feeding unit.
Figure 14:
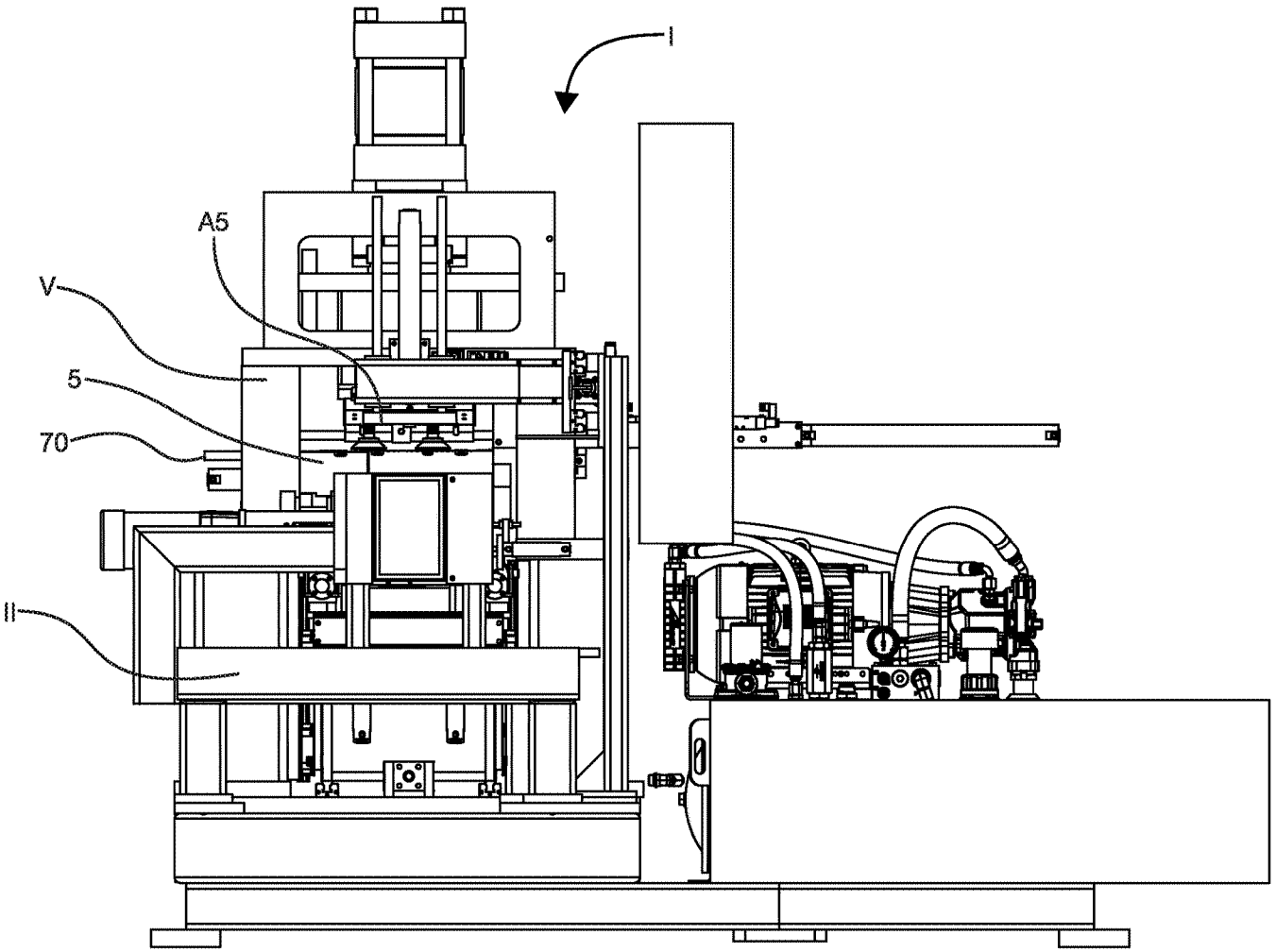
FIG. 14 is a rear view of the subject tube forming system.
Figure 30:
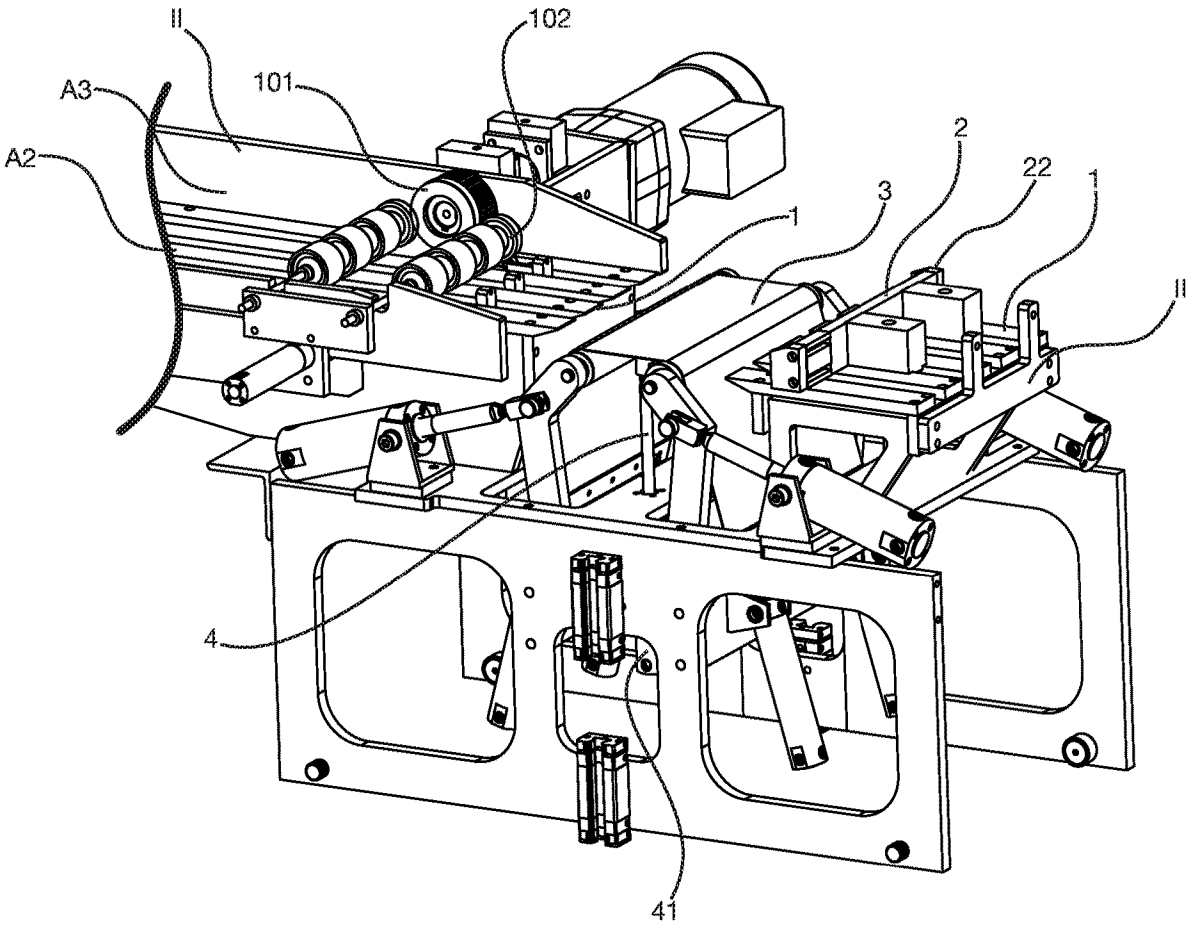
FIG. 30 is a perspective view of the wrap table system in position to receive a sheet metal blank from the conveyor system.
Figure 32:
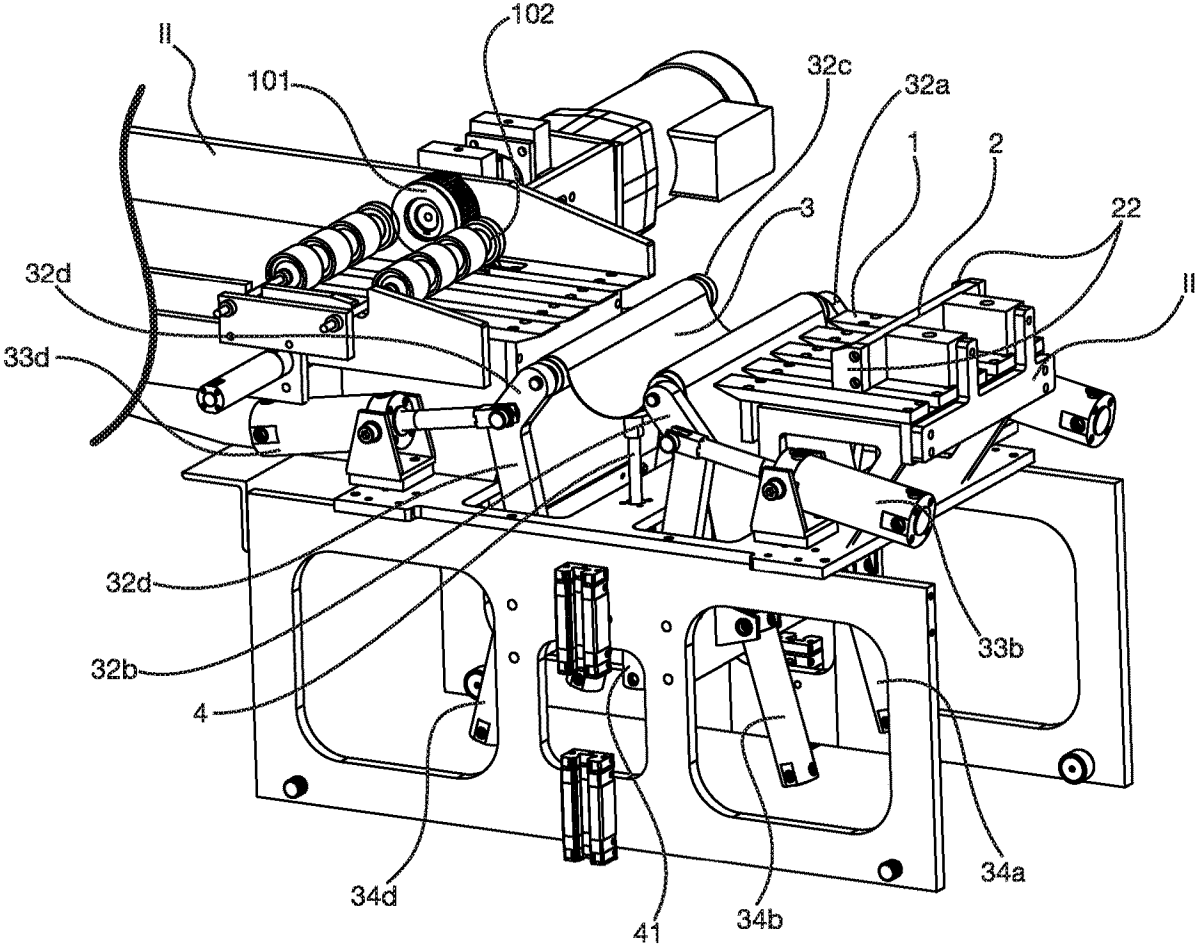
FIG. 32 is a perspective view of the wrap table system raised to force a sheet metal blank (not shown) around the mandrel (not shown) using support from bottom pusher bars.
Figure 33:
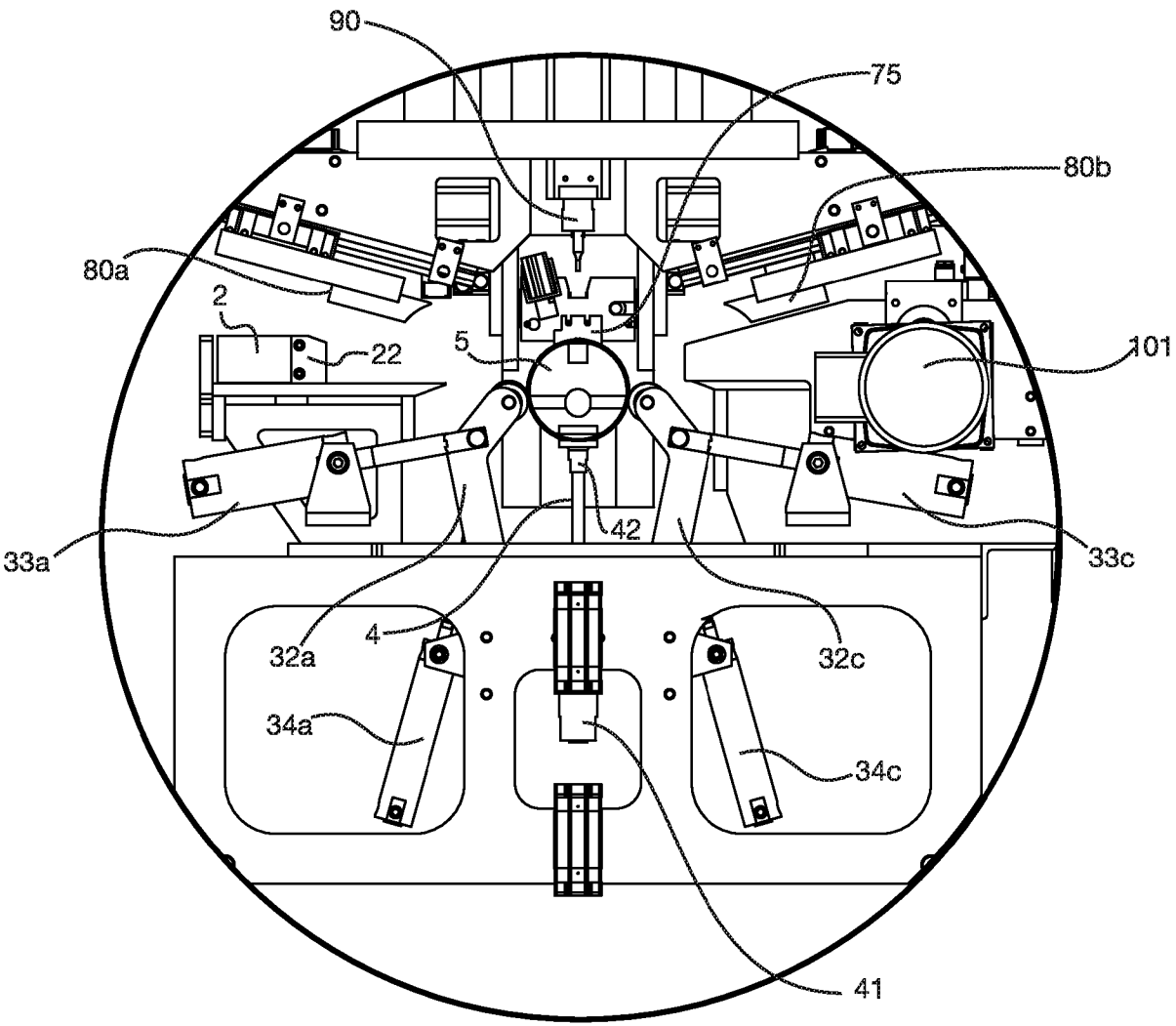
FIG. 33 is a side view similar to FIG. 32, but with the mandrel shown to illustrate the wrap strap rollers positioned for the sheet metal blank to be formed therearound.

Further, virtually any type of conveying system (A2) of the feeding unit (II) can be used to bring the sheet metal blanks (III) individually to the processing table (1). If the sheet metal blanks are to be corrugated first (e.g., before the strap wrap/mandrel step in FIG. 1), it is preferable that special arrangements such as a crimping station (101), seen in FIGS. 11, 12 and 18, be made to provide the desired metal formation (crimps 101(*a*)). In order to accommodate and correct for warping and/or deforming of the blanks caused by the corrugations (in this example), as well as stamping or punching (in other example), a straightening roller arrangement (102) can be provided as shown in FIGS. 30 and 32.

Accommodation for warping of the sheet metal blanks (III) can also include having increased side rails (A3) on the conveying system of other embodiments, and to increase the height of the stops (2, 22(*a*), 22(*b*)) on the processing table (1) of the subject integrated forming and clinching system (I). Also, additional straightening rollers (102) can be used to mitigate any extensive warping and/or deforming that might be caused by the corrugating, stamping or punching process steps. One expedient of the conveying system could be a mechanism that forces the sheet metal blanks (III) against the stops on the processing table. However, the method by which the sheet metal blanks are forced against the stops on the processing table can be any that are preferred in a particular manufacturing environment and is essentially left to the discretion of the user of the integrated system (I).

While a number of embodiments of the present invention have been described by way of example, the present invention is not limited thereto. Rather, the present invention should be interpreted to include any and all variations, modifications, derivations, and embodiments that would occur to one skilled in this art, having possession of the teachings of the instant application. Consequently, the present invention should be considered limited only by the following claims.

The invention claimed is:

1. A system for automatically forming sheet metal tubes from sheet metal blanks cut to size, said system comprising:

a) a moving mechanism with at least one conveyer for sequentially positioning each sheet metal blank into a predetermined position with a precise horizontal orientation for processing;

b) a lifting arrangement comprising a wrap strap and at least one pressure pad to vertically raise a positioned sheet metal blank to a forming station;

c) a forming station comprising a mandrel positioned so that the wrap strap extends on at least one side of said mandrel and underneath said positioned sheet metal blank, and at least one side wiper on each side of said mandrel, said side wipers configured to force overlap of opposite edges of said positioned sheet metal blank along a length of said mandrel, and said mandrel comprising a clinching die bar including clinching dies extending along said length of said mandrel;

d) a sealing mechanism comprising at least one vertically movable row of clinching prongs corresponding to said clinching die bar, said sealing mechanism configured to lower and attach said overlapping opposite edges of said sheet metal blank by clinching said opposite edges of said sheet metal blank at multiple positions to form a sheet metal tube around said mandrel; and, e) a separating mechanism configured to remove said sheet metal tube from said mandrel, said separating mechanism comprising a gag bar located within said mandrel and beneath said clinching die bar, and a stripper plate curved at least partially around said mandrel.

2. The system of claim 1, further comprising a fixed mandrel support and a sliding mandrel support arranged on first and second ends respectively of said mandrel.

3. The system of claim 2, wherein said mandrel is beveled in a direction from said first end to said second end.

4. The system of claim 3, wherein said clinching die bar is vertically adjustable.

5. The system of claim 3, wherein said sliding mandrel support is configured to automatically move from the second end of said mandrel for said sheet metal tube to be removed from said mandrel.

6. The system of claim 2, further comprising a sheet metal tube extraction support bar extending from said second end of said mandrel.

7. The system of claim 6, wherein said sheet metal tube extraction support bar extends along a common axis with said clinching die bar.

8. The system of claim 2, wherein said sealing mechanism further comprises a holding bar configured to remain on said overlapping opposite edges of said sheet metal blank at least until said clinching prongs are withdrawn from the corresponding die bar.

9. The system of claim 5, wherein the second end of said mandrel comprises a horizontal slot and a circular aperture.

10. The system of claim 9, wherein said sliding mandrel support comprises a horizontal bar configured to slide into said horizontal slot of the mandrel and a circular pin configured to extend into said circular aperture.

11. A method for forming a finished clinched sheet metal tube from a sheet metal blank cut to size, said method comprising:

a) moving said sheet metal blank to a position beneath a mandrel, wherein said mandrel has a first end connected to a fixed support and a second end connected to a movable support;

b) lifting and holding said sheet metal blank to a bottom apex of said mandrel and wrapping said sheet metal blank around a bottom portion of said mandrel with a wrap strap;

d) overlapping and holding opposing ends of said sheet metal blank across each other at a top portion of said mandrel using opposed side wipers;

e) clinching said overlapping opposite ends of said sheet metal blank using clinching dies mounted in said mandrel and complementary clinching prongs to form clinched overlapping opposite ends, thereby forming said sheet metal tube;

f) holding said clinched overlapping opposite ends of said sheet metal tube against the mandrel with a holding bar while withdrawing said clinching prongs;

g) automatically removing said clinched tube from the mandrel after moving said holding bar and said clinching prongs a predetermined distance away from said mandrel, said removing step including the sub-steps of:

(i) sliding said movable support away from said second end of said mandrel;

(ii) moving said die bar away from said overlapping opposite ends of said clinched tube into said mandrel; and, (iii) moving a stripper plate along the length of said mandrel to move said clinched tube toward an extraction support bar extending from said second end of said mandrel.

12. The method of claim 11, wherein said mandrel is beveled from the first end to said second end of said mandrel.

13. The method of claim 12, wherein said step of clinching is carried out along the length of said tube.

14. The method of claim 13, comprising the additional step of:

h) automatically removing said finished clinched tube from said extraction support bar.

* * * * *